US006496170B1

(12) United States Patent
Yoshida et al.

(10) Patent No.: US 6,496,170 B1
(45) Date of Patent: Dec. 17, 2002

(54) LIQUID CRYSTAL APPARATUS

(75) Inventors: Akio Yoshida, Hiratsuka; Katsumi Komiyama, Isehara; Takashi Enomoto, Sagamihara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/301,575

(22) Filed: Apr. 29, 1999

(30) Foreign Application Priority Data

Apr. 30, 1998 (JP) ..... 10-120657
Apr. 30, 1998 (JP) ..... 10-120658
Jul. 30, 1998 (JP) ..... 10-215285

(51) Int. Cl.[7] ..... G09G 3/30

(52) U.S. Cl. ..... 345/87; 345/92; 345/93; 345/94; 345/97; 345/98; 345/99; 345/101; 345/204; 345/206; 345/214; 349/33; 349/38; 349/174; 349/172

(58) Field of Search ..... 345/87, 89, 96, 345/97, 98, 211, 214, 92, 93, 94; 349/172, 33, 38, 174

(56) References Cited

U.S. PATENT DOCUMENTS 4,953,000 A 8/1990 Kaifu et al. ..... 357/71
5,396,352 A 3/1995 Kaneko et al. ..... 359/56
5,479,283 A 12/1995 Kaneko et al. ..... 359/79
5,675,351 A * 10/1997 Kaneko et al. ..... 345/87
5,751,267 A * 5/1998 Sato et al. ..... 345/96
5,936,689 A * 8/1999 Saishu et al. ..... 345/97
5,952,991 A * 9/1999 Akiyama ..... 345/98
6,046,790 A * 4/2000 Hara et al. ..... 349/172
6,069,602 A * 5/2000 Tanaka et al. ..... 345/89

FOREIGN PATENT DOCUMENTS

JP 56-107216 8/1981
JP 5-100208 4/1993
JP 9-068728 3/1997

OTHER PUBLICATIONS

T. Saishu et al., "Voltage–Holding Properties of Thresholdless Antiferroelectric Liquid Crystals Driven by Active Matrices", SID 96 Digest, 1996, pp. 703–706.
T. Yoshida et al., "A Full–Color Thresholdless Antiferroelectric LCD Exhibiting Wide Viewing Angle with Fast Response Time", SID 97 Digest, 1997, pp. 841–844.

* cited by examiner

*Primary Examiner*—Richard Hjerpe
*Assistant Examiner*—Ali Zamani
(74) *Attorney, Agent, or Firm*—Fitzpatrick, Cella, Harper & Scinto

(57) ABSTRACT

A liquid crystal apparatus comprises: a liquid crystal device including a liquid crystal having a spontaneous polarization and causing a state change accompanied with a polarity inversion thereof within a response time. Drive means sequentially selects scanning signal lines each in a scanning selection period and applies data signal voltages to the pixels along an associated scanning signal line, wherein the scanning selection period for a scanning signal line is shorter than the response time for the liquid crystal at a pixel on the scanning signal line thus being liable to leave a remaining portion of polarity inversion to reach a desired state change, and the data signal voltage applied to the pixel is set to include a compensation voltage for compensating for a voltage decrease caused by the remaining portion of polarity inversion.

25 Claims, 11 Drawing Sheets

LIQUID CRYSTAL APPARATUS

FIELD OF THE INVENTION AND RELATED ART

The present invention relates to a liquid crystal apparatus for effecting an active matrix drive by using a liquid crystal having a spontaneous polarization.

At present, most of liquid crystal display apparatus for use in monitors of liquid crystal television sets, word processors and personal computers principally employ a TN (twisted nematic) mode or an STN (super twisted nematic) mode using a nematic liquid crystal as a display mode.

In the case of using such a TN or STN mode for multiplex driving scheme, however, an increase in the number of scanning signal lines is liable to lower a contrast. Even if a drive waveform is optimized in order to provide practical display qualities, the number of scanning signal line has been restricted to ca. 400–500 lines at best.

In order to sole such a problem that display qualities are lowered with an increased number of scanning signal lines in a liquid crystal display mode (TN or STN mode), there has been proposed an active matrix (display) mode using a plurality of switching devices or devices, such as MIM (metal-insulator-metal) devices or TFTs (thin-film-transistors), disposed in a matrix form on a substrate.

In this case, however, a nematic liquid crystal used as a liquid crystal material therefor shows a slow response speed of several hundred msec particularly for gradation display signals, thus failing to follow high-speed motion display. As a result, it is difficult to provide sufficient display qualities. Further, in the above-mentioned TN (or STN) mode, liquid crystal molecules cause switching between a state where they are twisted and in parallel with a substrate and a state where they are perpendicular to the substrate, thus resulting in a large viewing angle-dependence based on its principle.

On the other hand, there have been developed display devices using a liquid crystal having a spontaneous polarization, such as a ferroelectric or chiral smectic liquid crystal, in view of, e.g., a higher-speed responsiveness and a wider viewing-angle characteristic when compared with those of the TN or (STN) mode using the nematic liquid crystal.

For example, as a display device using a liquid crystal showing ferroelectricity, there has been proposed a surface-stabilized ferroelectric liquid crystal display device as described in Japanese Laid-Open Patent Application (JP-A) 56-107216, wherein multiplex driving scheme is practiced according to a simple matrix mode utilizing bistability of liquid crystal molecules. However, this driving scheme fails to continuously change a resultant transmittance since it performs two-value (binary) driving using bistable states of liquid crystal molecules, thus not facilitating gradational display. For this reason, there have been proposed various gradational display methods using, e.g., pixel division, time-division display, and image processing.

Further, there have been proposed active matrix driving schemes utilizing a high-speed responsiveness and a wide view-angle characteristic of a ferroelectric or antiferroelectric liquid crystal. For example JP-A 5-100208 discloses a method of effecting gradational display by performing active matrix driving of an antiferroelectric liquid crystal assuming three stable states and JP-A 9-68728 discloses a gradational display method using an active matrix driving scheme and a thresholdless-antiferroelectric liquid crystal (TL-AFLC).

However, in the case of the active matrix driving scheme using a chiral smectic liquid crystal (e.g., a ferroelectric or antiferroelectric liquid crystal), an effective voltage applied to the liquid crystal is substantially lowered to cause image-quality deterioration as described in, e.g., (1) A full-color thresholdless Antiferroelectric LCD exhibiting wide viewing angle with fast response time, T. Yoshida et al., SID (Society for Information Display) 97 DIGEST, pp. 841–844, and (2) Voltage-holding properties of thresholdless Antiferroelectric liquid crystals driven by active matrices, T. Saishu et al., SID 96 DIGEST, pp. 703–706. More specifically, in the case where an antiferroelectric (or ferroelectric) liquid crystal having a spontaneous polarization is driven (i.e., subjected to switching) by using an active element or device (e.g., TFT), an inversion of the spontaneous polarization of the liquid crystal causes a lowering in holding voltage to substantially decrease a voltage applied to the liquid crystal, thus resulting in a deterioration in image qualities, such as a low contrast.

The lowering in holding voltage leading to inferior image qualities will be simply described hereinbelow with reference to FIGS. 3–5.

FIG. 4 shows an equivalent circuit of one pixel portion of a liquid crystal device using a liquid crystal having a spontaneous polarization (in this instance, the TL-AFLC as described in the above document (1) is used), and FIG. 3 shows a V-T (voltage-transmittance) curve as an optical response characteristic of the liquid crystal device using the TL-AFLC when a low-frequency triangular waveform is applied.

Referring to FIG. 4, the equivalent circuit includes a TFT 14, a liquid crystal capacitance ($C_{lc}$) 31, a storage capacitance (Cs) 32, a spontaneous polarization of the liquid crystal (Ps) 50, a storage capacitance electrode 30 and a common electrode 42. The TFT 14 includes a gate electrode, a source electrode and a drain electrode and supplies a voltage to the liquid crystal through the drain electrode. The storage capacitance (Cs) 32 for holding a voltage applied to the liquid crystal layer at the time of "OFF" state of the TFT 14 is disposed in parallel with the liquid crystal capacitance (Clc) 31.

FIGS. 5A–5D show drive waveforms applied to the pixel (shown in FIG. 4) and an optical response (transmittance) of the liquid crystal. More specifically, FIG. 5A shows a voltage waveform of a scanning selection signal applied to a scanning signal line (gate line) connected to the gate electrode of the TFT 14. FIG. 5B shows a data signal voltage waveform applied to a data signal line (source line) connected to the source electrode of the TFT 14. FIG. 5C shows a voltage waveform applied to the liquid crystal layer (portion) of the pixel concerned. FIG. 5D shows a transmittance of the pixel.

Referring to FIG. 5A, a gate voltage Vg as a signal for placing the gate of the TFT 14 in an "ON" state is periodically applied in every selection period Ton. In synchronism with the gate voltage Vg, a source voltage (data signal voltage) Vs is applied to the source electrode, thus being supplied to the liquid crystal layer via the drain electrode of the TFT 14 (FIG. 5B). The source voltage Vs has a polarity which is inverted periodically in order to prevent a deterioration of the liquid crystal due to an asymmetrical voltage applied to the liquid crystal layer. Referring to FIG. 5C, a voltage Vpix applied to the liquid crystal layer is applied in a selection period Ton so that the Vpix has a polarity which is opposite to that in a period immediately before the selection period Ton. The liquid crystal starts to transfer its alignment state to that depending on the polarity of the voltage Vpix applied to the liquid crystal layer in the selection period Ton. If the response time of the liquid crystal is sufficiently shorter than the Ton, the transfer of the liquid crystal is continued to a (subsequent) non-selection period Toff by a voltage based on a storage capacitance. The liquid crystal used has a spontaneous polarization, so that a voltage decrease (lowering) (corresponding to ΔV) is caused by the spontaneous polarization when the direction thereof is inverted (FIG. 5C). As a result, the liquid crystal is finally placed in an alignment state corresponding to the voltage Vpix including the voltage drop ΔV. Accordingly, as shown in FIG. 5D, an optical response of the liquid crystal is also continued to the non-selection period Toff.

As described above, in order to obtain a desired optical (display) state, it is necessary to effect a drive in view of the voltage drop due to the spontaneous polarization. The voltage drop phenomenon is, however, affected by the spontaneous polarization of the liquid crystal, driving voltage, storage capacitance, liquid crystal capacitance, etc., thus leading to such a problem that a desired gradational data is not accurately displayed.

SUMMARY OF THE INVENTION

A principal object of the present invention is to provide a liquid crystal apparatus having solved the above problems caused by the voltage decrease based on inversion of a spontaneous polarization of a liquid crystal.

A specific object of the present invention is to provide a liquid crystal apparatus capable of improving image qualities, particularly for gradational display, such as a contrast, while retaining a high-speed responsiveness at the time of effecting display by driving a liquid crystal device using a liquid crystal having a spontaneous polarization according to an active matrix driving scheme.

According to the present invention, there is provided a liquid crystal apparatus, comprising:

a liquid crystal device including an active matrix substrate, a counter substrate disposed opposite thereto, and a liquid crystal disposed between the active matrix substrate and the counter substrate; said active matrix substrate having thereon a plurality of scanning signal lines, a plurality of data signal lines intersecting the scanning signal lines, a plurality of switching devices each disposed at an intersection of the scanning signal lines and the data signal lines and connected to an associated one of the scanning signal lines, and a plurality of pixel electrodes each connected via one of the switching devices to an associated one of the data signal lines and form a pixel together with the liquid crystal thereat for applying a data signal voltage to the liquid crystal at the pixel; said liquid crystal having a spontaneous polarization and causing a state change accompanied with a polarity inversion thereof within a response time, and drive means for sequentially selecting the scanning signal lines each in a scanning selection period and applying data signal voltages to the pixels along an associated scanning signal line, wherein the scanning selection period for a scanning signal line is shorter than the response time for the liquid crystal at a pixel on the scanning signal line thus being liable to leave a remaining portion of polarity inversion to reach a desired state change, and the data signal voltage applied to the pixel is set to include a compensation voltage for compensating for a voltage decrease caused by the remaining portion of polarity inversion.

According to the present invention, there is also provided a liquid crystal apparatus, comprising:

a liquid crystal device including an active matrix substrate, a counter substrate disposed opposite thereto, and a liquid crystal disposed between the active matrix substrate and the counter substrate; said active matrix substrate having thereon a plurality of scanning signal lines, a plurality of data signal lines intersecting the scanning signal lines, a plurality of switching devices each disposed at an intersection of the scanning signal lines and the data signal lines and connected to an associated one of the scanning signal lines, and a plurality of pixel electrodes each connected via one of the switching devices to an associated one of the data signal lines and form a pixel together with the liquid crystal thereat for applying a data signal voltage to the liquid crystal at the pixel; each pixel being provided with a storage capacitance disposed in parallel with the liquid crystal, and said liquid crystal having a spontaneous polarization and causing a state change accompanied with a polarity inversion thereof within a response time, and drive means for sequentially selecting the scanning signal lines each in a scanning selection period and applying data signal voltages to the pixels along an associated scanning signal line, wherein the scanning selection period for a scanning signal line is shorter than the response time for the liquid crystal at a pixel on the scanning signal line thus being liable to leave a remaining portion of polarity inversion to reach a desired state change, and the liquid crystal device and the drive means are set to satisfy the following conditions:

$$Vs2 \geqq \{\Delta Q \times M/(C_{lc}+Cs)\}+Vs1 \quad (12)$$

wherein Vs2 is a data signal voltage (volt) applied to one pixel, Vs1 is a voltage (volt) for providing writing data for the pixel based on a voltage-transmittance characteristic of the liquid crystal, ΔQ is an amount (C) of inversion of the spontaneous polarization of the liquid crystal, $C_{lc}$ is a liquid crystal capacitance (F) at one pixel, Cs is a storage capacitance (F) at one pixel, and M is a proportion of the remaining portion of polarity inversion in a scanning selection period for one scanning signal line.

According to the present invention, there is further provided a liquid crystal apparatus, comprising:

a liquid crystal device including an active matrix substrate, a counter substrate disposed opposite thereto, and a liquid crystal disposed between the active matrix substrate and the counter substrate; said active matrix substrate having thereon a plurality of scanning signal lines, a plurality of data signal lines intersecting the scanning signal lines, a plurality of switching devices each disposed at an intersection of the scanning signal lines and the data signal lines and connected to an associated one of the scanning signal lines, and a plurality of pixel electrodes each connected via one of the switching devices to an associated one of the data signal lines and form a pixel together with the liquid crystal thereat for applying a data signal voltage to the liquid crystal at the pixel; each pixel being provided with a storage capacitance disposed in parallel with the liquid crystal, and said liquid crystal having a spontaneous polarization and causing a state change accompanied with a polarity inversion thereof within a response time, and drive means for sequentially selecting the scanning signal lines each in a scanning selection period and applying data signal voltages to the pixels along an associated scanning signal line, wherein the scanning selection period for a scanning signal line is shorter than the response time for the liquid crystal at a pixel on the scanning signal line thus being liable to leave a remaining portion of polarity inversion to reach a desired state change, and the liquid crystal device and the drive means are set to satisfy the following conditions:

$$1/(n-1)>A(2Ps\times S)/V_0(C_{lc}+Cs)_{ave},$$

wherein n represents the number of gradational levels per one period; A is represented by the following equation:

$$A=\{(C_{lc}+Cs)_{max}-(C_{lc}+Cs)_{min}\}/(C_{lc}+Cs)_{ave},$$

where $(C_{lc}+Cs)_{max}$ represents a maximum of the sum ($C_{lc}$+Cs) of a liquid crystal capacitance $C_{lc}$ (F) at one pixel and a storage capacitance Cs (F) at one pixel, $(C_{lc}+Cs)_{min}$ represents a minimum of ($C_{lc}$+Cs) and $(C_{lc}+Cs)_{ave}$ represents an average of ($C_{lc}$+Cs); Ps represents a spontaneous polarization ($C/cm^2$) per unit area of the liquid crystal; S represents a pixel electrode area ($cm^2$) at one pixel; and $V_0$ represents a saturation voltage (volt) for the liquid crystal providing a maximum transmittance.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Some preferred embodiments of the liquid crystal apparatus of the present invention will be described with reference to the drawings.

First Embodiment

In a first embodiment, a liquid crystal apparatus is constituted by a liquid crystal device (panel) including an active matrix substrate provided with a plurality of switching devices and a plurality of pixel electrodes, a counter substrate provided with a common electrode, and a liquid crystal having a spontaneous polarization disposed between the active matrix and counter substrates, and by a drive means for driving the liquid crystal device.

Figure 1:
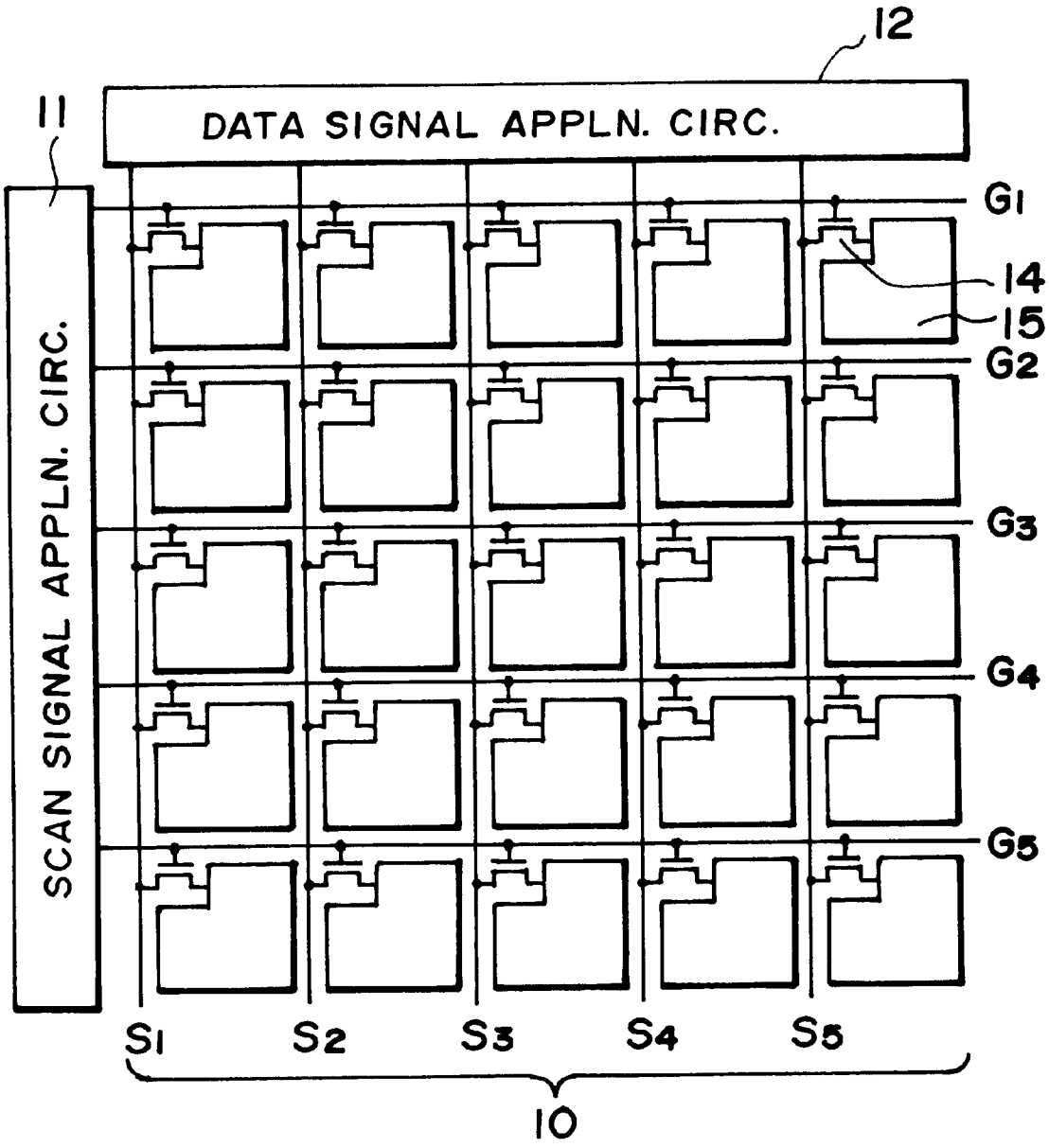
FIG. 1 is a schematic plan view of a liquid crystal panel (device) used in the liquid crystal apparatus according to the present invention.

FIG. 1 shows a schematic plan view of such a liquid crystal device in combination with drive means (drive circuits) used in the liquid crystal apparatus of the present invention x and principally illustrates a structure of the active matrix substrate.

Referring to FIG. 1, a liquid crystal device (panel) 10 includes a structure such that gate lines (G1, G2, G3, G4, G5, . . . ) corresponding to scanning lines connected to a scanning signal driver 11 (drive means) and source lines (S1, S2, S3, S4, S5, . . . ) corresponding to data signal lines connected to a data signal driver 12 (drive means) are disposed to intersect each other at right angles in an electrically isolated state, thus forming a plurality of pixels (5×5 in FIG. 1 for simplicity) each at intersection thereof. Each pixel is provided with a thin film transistor (TFT) 14 as a switching device or element and a pixel electrode 15. The switching device may be a metal-insulator-metal (MIM) device. The gate lines (G1, G2, . . . ) are connected with gate electrodes (not shown) of the TFT 14, respectively, and the source lines (S1, S2, . . . ) are connected with source electrodes (not shown) of the TFT 14, respectively. The pixel electrodes 15 are connected with drain electrodes (not shown) of the TFT 14, respectively.

A gate voltage is supplied to the gate lines (G1, G2, . . . ) from the scanning signal driver 11 by effecting scanning selection in, e.g., a line-sequential manner. In synchronism with this scanning selection on the gate lines, the source lines (S1, S2, . . . ) are supplied with a data signal voltage depending on writing data for each pixel from the data signal driver 12. The thus-supplied gate and data signal voltages are applied to each pixel electrode 15 via the TFT 14.

Figure 2:
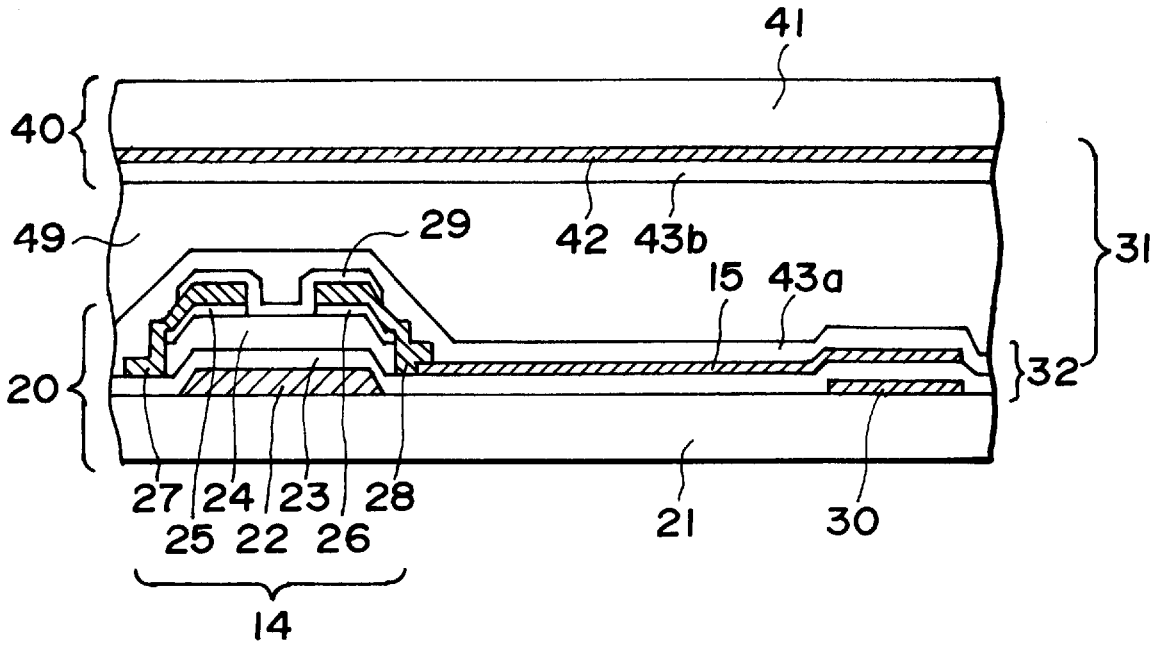
FIGS. 2 and 10 are respectively a schematic sectional view of an example of a one-pixel portion of a liquid crystal device used in the liquid crystal apparatus according to the present invention.

FIG. 2 shows a sectional structure of a one-pixel portion (corr. to 1 bit portion) in the panel structure shown in FIG. 1.

Referring to FIG. 2, a layer of a liquid crystal material 49 having a spontaneous polarization are sandwiched between an active matrix plate 20 provided with a TFT 14 and a pixel electrode 15 and a counter plate 40 provided with a common electrode 42, thus providing a liquid crystal capacitance (Clc) 31. The liquid crystal capacitance 31 includes alignment films 43*a* and 43*b* but these films are very thin, thus being substantially constituted by the pixel electrode 15, the common electrode 42 and the liquid crystal layer 49.

In this embodiment, the active matrix plate 20 includes an amorphous silicon (a-Si) TFT as the TFT 14.

The TFT 14 is formed on an active matrix substrate 21 of, e.g., glass and includes: a gate electrode 22 connected with the gate lines (G1, G2, . . . shown in FIG. 1); an insulating film (gate insulation film) 23 of, e.g., silicon nitride (SiNx) formed on the gate electrode 22; an a-Si layer 24 formed on the insulating film 23; $n^+$ a-Si layers 25 and 26 formed on the a-Si layer 24 and spaced apart from each other; a source electrode 27 formed on the $n^+$ a-Si layer 25; a drain electrode 28 formed on the $n^+$ a-Si layer 26 and spaced apart from the source electrode 27; a channel protective film 29 partially covering the a-Si layer 24 and the source and drain electrodes 27 and 28. The source electrode 27 is connected with the source lines (S1, S2, . . . shown in FIG. 1) and the drain electrode 28 is connected with a pixel electrode 15 of a transparent conductor film (e.g., ITO (indium-tin-oxide) film). The TFT 94 is placed in an "ON" state by applying a gate pulse to the gate electrode 22 in a scanning selection period of the corresponding gate line.

Further, on the active matrix substrate 20, a structure constituting a storage or holding capacitance (supplementary capacitance) (Cs) 32 is constituted by the pixel electrode 15, a storage capacitance electrode 30 disposed on the (glass) substrate 21, and the insulating film 23 (extending from that of the TFT portion on the gate electrode 22) disposed therebetween. The structure (storage capacitance) (Cs) 32 is disposed in parallel with the liquid crystal capacitance (structure) (Clc) 31. In the case where the storage capacitor electrode 30 has a large area, a resultant opening rate is decreased. In such a case, the storage capacitor electrode 30 is formed of a transparent conductor film (e.g., ITO film).

On the TFT 14 and the pixel electrode 15 of the active matrix plate 20, an alignment film 43*a* for controlling an alignment state of the liquid crystal 49. The alignment film 43*a* may preferably be subjected to a uniaxial alignment treatment (e.g., rubbing).

On the other hand, the counter plate 40 includes a counter substrate (e.g., glass substrate) 41; a common (counter) electrode 42 having a uniform thickness disposed on the entire substrate 41; and an alignment film 43*b* having a uniform thickness, disposed on the common electrode 42, for controlling an alignment state of the liquid crystal 49.

The above panel structure (liquid crystal device) including a plurality of the pixels each having the structure shown in FIG. 2 is sandwiched between a pair of polarizers (not shown) with polarizing axes intersecting each other at right angles.

Referring to FIG. 2, the liquid crystal layer 49 comprises a liquid crystal material, such as a chiral smectic liquid crystal, a ferroelectric liquid crystal or an antiferroelectric liquid crystal. In a particularly preferred embodiment, the liquid crystal layer 49 may preferably be set by appropriately selecting a composition of the liquid crystal material and a panel structure so that the liquid crystal material used has a voltage (applied voltage)–transmittance (V-T) characteristic as shown in FIG. 3 representing a thresholdless V-T characteristic when supplied with a DC rectangular wave voltage according to a static drive scheme.

Figure 3:
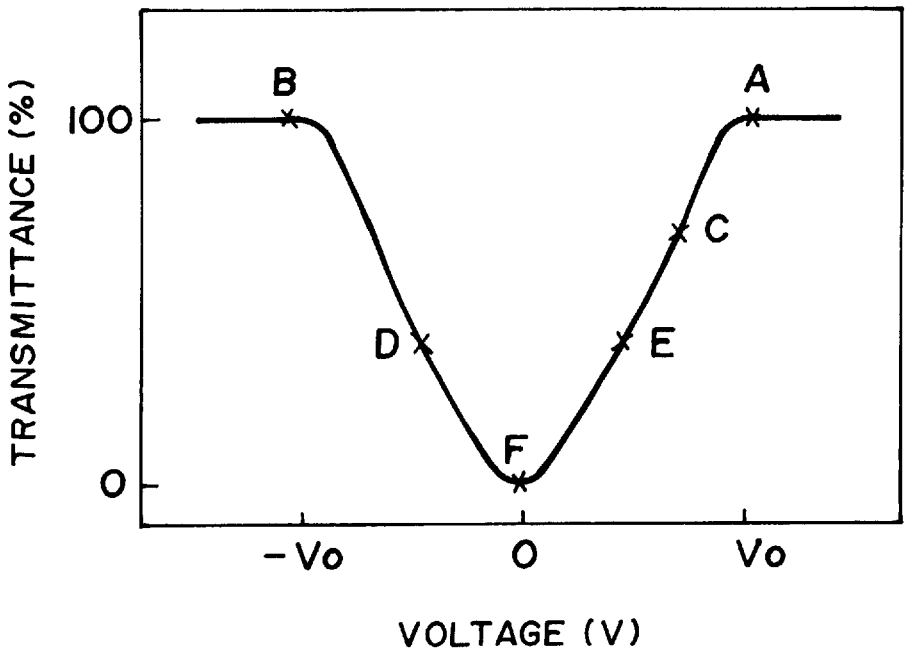
FIG. 3 is a graph showing a voltage-transmittance characteristic when a liquid crystal layer in the liquid crystal apparatus of the present invention is supplied with a rectangular wave voltage.

More specifically, as shown in FIG. 3, the liquid crystal assumes a first alignment state exhibiting a first transmittance under no voltage application (under no electric field), is tilted from the first alignment state to a second alignment state in one direction when supplied with a voltage of a first polarity (e.g., a positive-polarity voltage) to exhibit a second transmittance at a prescribed voltage $V_0$, and is tilted from the first alignment state to a third alignment state in the other direction when supplied with a voltage of a second polarity opposite to the first polarity (e.g., a negative-polarity voltage) to exhibit a second transmittance at a prescribed voltage $-V_0$ Further, the pair of polarizers are disposed so that the first transmittance is substantially zero (%) and the second transmittance is a maximum transmittance (100%), whereby the liquid crystal changes its transmittance continuously between the first transmittance and the second transmittance depending on a voltage value applied thereto, thus allowing gradational display depending on the applied voltage.

The one-pixel portion of the liquid crystal device shown in FIG. 2 is represented by an equivalent circuit shown in FIG. 4 (as specifically described hereinabove).

As the active matrix plate 20 (as described with reference to FIGS. 1 and 2), it is also possible to use a (glass) substrate having thereon a polycrystalline (p-)Si TFT as the TFT.

Figure 10:
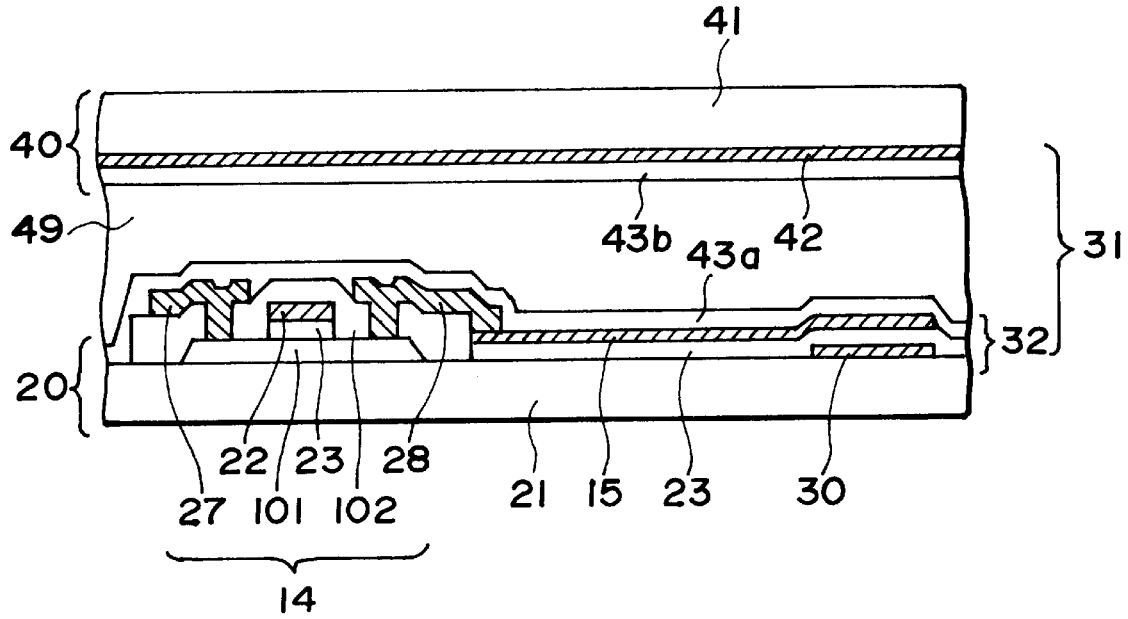

FIG. 10 illustrates a sectional structure of a one-pixel portion (1 bit portion) of a liquid crystal device using such a p-Si TFT. The structure is identical to that of the liquid crystal device using the α-Si TFT (FIG. 1) except for a TFT structure.

Referring to FIG. 10, a p-Si TFT (structure) 14 includes a p-Si layer 101 formed on an active matrix substrate 21 (e.g., a glass substrate). On the p-Si layer 101, a gate electrode 22 connected to the gate liens (G1, G2, . . . shown in FIG. 1) via a gate insulation film 23. Further, on the p-Si layer 101, a passivation film 102 is disposed so as to cover the gate electrode 22 and the gate insulation film 23. The passivation film 102 has two through-holes through which a source electrode 27 and a drain electrode 28 are connected to the p-Si layer 101, respectively.

Next, an example of an ordinary active matrix driving scheme applicable to the liquid crystal apparatus as described above will be described with reference to FIGS. 1–5.

Figure 4:
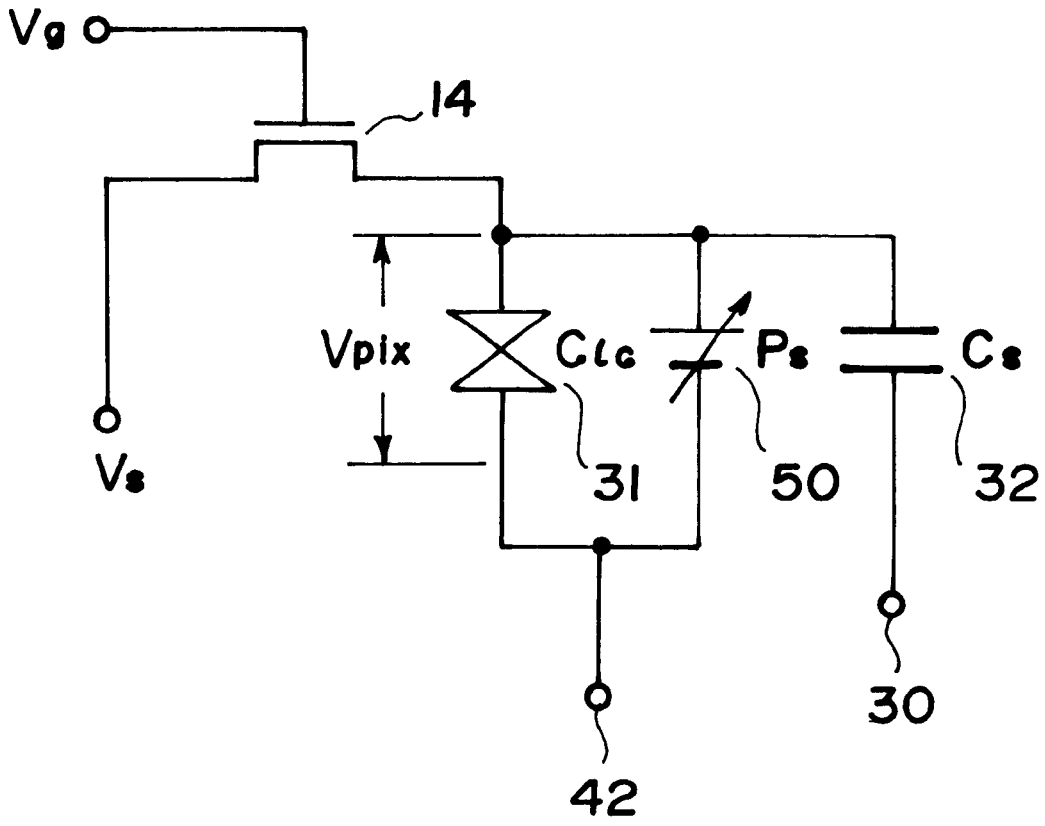
FIG. 4 is an equivalent circuit diagram of a one-pixel portion of a liquid crystal device used in the liquid crystal apparatus.

FIG. 4 shows an example of an equivalent circuit for each (one-)pixel portion of such a liquid crystal apparatus shown in FIG. 1.

Figures 5A, 5B, 5C, 5D:
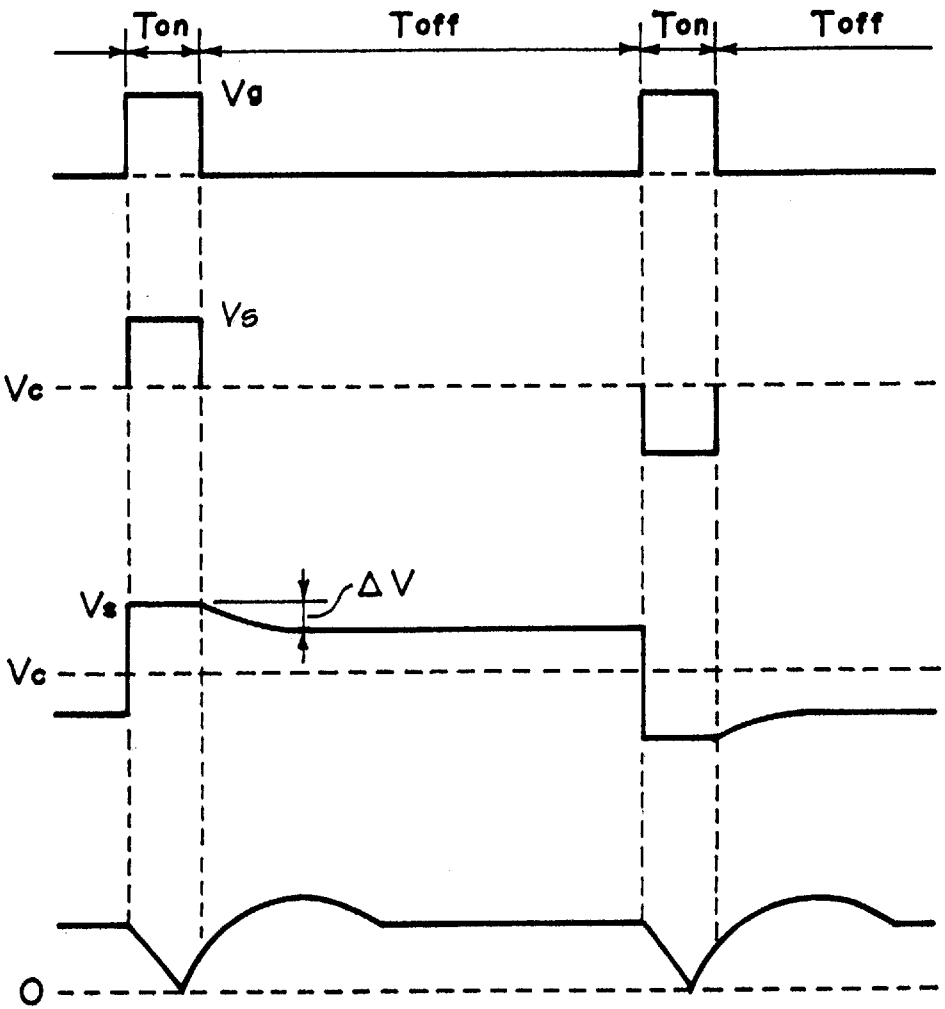
FIGS. 5A–5D are a scanning signal voltage waveform, a data signal voltage waveform, a voltage waveform applied to a pixel, and an optical response (transmittance) at the pixel, respectively, for an ordinary active matrix drive.

FIG. 5A shows a voltage waveform applied to one gate line (e.g., G1 shown in FIG. 1) (as a scanning signal line) connected with each pixel.

In the liquid crystal apparatus driven by the active matrix driving scheme, the gate lines G1, G2, . . . shown in FIG. 1 are selected in a line-sequential scanning manner. At this time, a gate electrode 22 connected with a corresponding gate line is supplied with a prescribed gate voltage Vg in a selection period $T_{on}$, thus placing the TFT 14 in an "ON" state. In a non-selection period $T_{off}$ corresponding to a period in which other gate lines are selected, the gate electrode 22 is not supplied with the gate voltage Vg, thus placing the TFT 14 in an "OFF" state (high-resistance state). In every non-selection period $T_{off}$, a prescribed (and same) gate line is selected and a corresponding gate electrode 22 is supplied with the gate voltage Vg.

FIG. 5B shows a voltage waveform applied to one source line (e.g., S1 shown in FIG. 1) (as a data signal line) connected to the pixel concerned.

When the gate electrode 22 is supplied with the gate voltage Vg in the selection period $T_{on}$ as shown in FIG. 5A, in synchronism with this voltage application, a prescribed source voltage (data signal voltage) Vs having a potential providing a prescribed writing data (e.g., an optical state or display information (transmittance) intended to be obtained at the pixel based on V-T characteristic of the liquid crystal used as shown in FIG. 3) to the pixel concerned is applied to a source electrode 27 through the source line connected with the pixel based on a potential Vc of a common electrode 42 as a reference potential.

At that time, the TFT 14 is in an "ON" state, whereby the source voltage Vs applied to the source electrode 27 is applied to a pixel electrode 15 via a drain electrode 28, thus electrical charging a liquid crystal capacitance (Clc) 31 and a storage (holding) capacitance (Cs) 32. As a result, the potential of the pixel electrode 15 becomes a level equal to that of the source (data signal) voltage Vs.

Thereafter, in a subsequent non-selection period $T_{off}$ of the gate line on the pixel concerned, the TFT 14 is in an "OFF" (high-resistance) state. At this time, in the liquid crystal cell, ideally, the liquid crystal capacitance (Clc) 31 and the storage capacitance (Cs) 32 retain the electric charges therein, respectively, charged in the selection period $T_{on}$ to keep the voltage Vs. As a result, the liquid crystal layer 49 of the pixel is supplied with the voltage Vs through one frame period to provide a desired optical state (display data) at the pixel depending on the voltage value. Particularly, by appropriately control a voltage value of the data signal voltage Vs depending on a desired image information (data), it is possible to effect gradational display wherein the liquid crystal changes its transmittance continuously along a V-T curve as shown in FIG. 3.

The data signal (source) voltage Vs may preferably have a polarity which is inverted for a prescribed period (e.g., a frame period) as shown in FIG. 3, so that the polarity of a voltage applied to the liquid crystal layer 49 is inverted for each frame period. As a result, the voltage waveform actually applied to the liquid crystal layer 49 is controlled not to be asymmetrical, thus suppressing a deterioration of the liquid crystal material.

FIG. 5C shows schematically a waveform of a (pixel) voltage Vpix actually held by the liquid crystal capacitance (Clc) 31 and the storage capacitance (Cs) 32 of the pixel concerned and also applied to the liquid crystal layer 49 when the liquid crystal having a spontaneous polarization is driven, and FIG. 5D shows schematically an example of an actual optical response (transmittance) at the pixel concerned.

The liquid crystal layer 49 comprises a liquid crystal material (e.g., a chiral smectic liquid crystal) having a spontaneous polarization as described above, so that switching (between the alignment states) is caused by inversion of the spontaneous polarization direction at the time of application of a prescribed voltage Vs in a selection period Ton. As a result, electrical charges charged by the liquid crystal capacitance (Clc) 31 and the storage capacitance (Cs) 32 are consumed depending on a degree of the spontaneous polarization inversion. At that time, if the liquid crystal having the spontaneous polarization shows a sufficiently quick response speed so that the switching is completed within the selection period Ton, electrical charges are charged or stored in the liquid crystal and storage capacitances (Clc and Cs) 31 and 32 in the selection period Ton so that the resultant charges are those including the consumed ones (by the spontaneous polarization inversion) and necessary to keep the voltage Vs. In this instance, a further switching of the liquid crystal is not caused in a subsequent non-selection period Toff, so that the electrical charges stored in the selection period Ton immediately before the Toff are not consumed. As a result, the (data signal) voltage Vs is held by the capacitances of the pixel concerned in also the non-selection period Toff, thus providing a desired optical state or a desired display information depending on the voltage value of Vs.

In the above-described active matrix drive scheme for driving the liquid crystal apparatus, a scanning selection period (Ton) for one scanning signal line (one gate line) is determined unambiguously by a frame frequency and the number of scanning signal lines of the liquid crystal apparatus used. In recent years, the liquid crystal apparatus is required to have a larger size and a higher resolution and effect motion display, so that the number of gate lines G1, G2, . . . and the frame frequency are increased, thus resulting in a shorter (smaller) selection period (Ton). Particularly, in the case where image signals corresponding to those for ordinary CRT displays are utilized, a frequency employed therefor is a certain value. In this case, one horizontal scan (selection) period is unambiguously determined by the liquid crystal panel structure (the number of scanning signal lines), thus considerably shortening the selection period Ton.

For example, when a liquid crystal display apparatus including 1000 scanning signal lines is driven at a frequency of 60 Hz, one horizontal scan period is 16 μsec. On the other hand, a practical liquid crystal material (particularly, one showing antiferroelectricity) exhibiting the V-T characteristic as shown in FIG. 3 can provide a switching speed (time) of several ten psec to several hundred psec in some cases when a switching from a point A (shown in FIG. 3) providing a maximum transmission state under application of a one-polarity voltage to a point B providing a maximum transmission state under application of the other (opposite)-polarity voltage although the switching time varies depending on the applied voltage, the operating temperature, etc. In a low-temperature environment (e.g., at ca. 5° C.), the response time exceeds 1 msec in some cases. Accordingly, the current liquid crystal material having a particle size is liable to fail to ensure a response time (speed) sufficient to complete the switching within the selection period Ton.

Herein, the "response time" refers to a time required for switching between two maximum transmission states (e.g., point A and point B) as shown in FIG. 3 in the case where a polarity of a drive (data signal) voltage is inverted for each pixel (frame inversion drive) or a time required for a transmittance change (0%⇆100%) between a maximum transmission state (e.g., point A shown in FIG. 3) and a minimum transmission state (e.g., point F) in the case where the frame inversion drive is not performed.

In this case, the switching in the liquid crystal layer 49 is caused and continued from the selection period Ton to the non-selection period Toff, whereby the electrical charges stored in the liquid crystal capacitance (Clc) and the storage capacitance (Cs) are consumed depending on a degree of the above-mentioned spontaneous polarization inversion. In the non-selection period Toff, a further electrical charging is not performed by the liquid crystal capacitance (Clc) and the storage capacitance (Cs), so that a (pixel) voltage Vpix applied to the liquid crystal layer 49 is lowered from the original (data signal) voltage Vs by a voltage decrement ΔV corresponding to the amount of the consumed electrical charges as shown in FIG. 5C. As a result, at the pixel, the voltage Vs for providing a prescribed optical state or display data is not applied to the liquid crystal layer 49. Actually, the liquid crystal layer 49 is supplied with a lower voltage (Vs−ΔV) providing an optical state or display data different from those of desired levels, thus failing to effect desired data-switching operation.

In the case where the liquid crystal device using the liquid crystal having a spontaneous polarization is driven by the active matrix drive scheme as described above, a net voltage decrement ΔV1 (V: volt) for switching of the liquid crystal at one-pixel portion of the liquid crystal layer 49 is given by the inversion of the spontaneous polarization of the liquid crystal and is determined according to the following equation (1):

$$\Delta V1=\Delta Q/Clc(1+\alpha)(\alpha=Cs/Clc) \quad (1),$$

wherein ΔQ (C) is an amount of inversion of the spontaneous polarization of the liquid crystal at one pixel, Clc (F) is a liquid crystal capacitance at one pixel, and Cs (F) is a storage capacitance at one pixel.

Particularly, in the case of the liquid crystal device providing the V-T characteristic as shown in FIG. 3, when the liquid crystal is switched in its alignment state from a maximum transmission state (point A) under application of one-polarity voltage, e.g., a positive-polarity voltage to another maximum transmission state (point B) under application of the other (opposite)-polarity (e.g., negative-polarity voltage), i.e., when a bright (while) state is continuously displayed in plural frames, the above parameter ΔQ is represented by the formula: ΔQ=2Ps×S where Ps ($C/cm^2$) is a spontaneous polarization intrinsic to the liquid crystal material used and S ($cm^2$) is an (effective) area of the pixel electrode.

Accordingly, a maximum (ΔVmax1:V) of the voltage decrement is obtained according to the following equation (2):

$$\Delta V\max\mathbf{1}=2Ps\times S/Clc(1+\alpha) \quad (2).$$

More specifically, the maximum voltage decrement ΔVmax1 (V) is calculated by the above equation (2) while changing values of Ps (spontaneous polarization of the liquid crystal) and α (which is determined unambiguously by the liquid crystal panel structure) and setting Clc=1.77 $nF/cm^2$ and S=300 μm×100 μm×0.7 (opening rate: 70%).

The results are shown in Table 1.

TABLE 1

| | Vmax1 (volt) | | | | |
|---|---|---|---|---|---|
| | Ps ($nC/cm^2$) | | | | |
| α | 5 | 12.5 | 25 | 40 | 60 |
| 5 | 0.94 | 2.35 | 4.71 | 7.53 | 11.3 |
| 10 | 0.51 | 1.28 | 2.57 | 4.10 | 6.16 |
| 20 | 0.27 | 0.67 | 1.35 | 2.15 | 3.23 |
| 40 | 0.41 | 0.34 | 0.69 | 1.10 | 1.65 |
| 80 | 0.07 | 0.17 | 0.35 | 0.55 | 0.84 |

As apparent from Table 1, a larger ΔVmax1 is given by a larger Ps or a smaller α.

In an actual liquid crystal panel, a selection period Ton for one pixel is shorter, so that it is difficult to complete the switching of liquid crystal (i.e., inversion of the spontaneous polarization) in the period Ton. As a result, most of the switching (inversion) is liable to occur in a subsequent non-selection period Toff (immediately after the Ton). For this reason, in an actual (active matrix) drive, a voltage applied to the liquid crystal layer 49 in the non-selection period Toff is considered to be lowered from the prescribed voltage level Vs by a voltage decrement ΔV1 which can be closer to the ΔVmax1 (shown in Table 1) as a maximum level.

Referring again to FIG. 3, when writing operation from a gradational (display) state (point C) to a gradational state (point D) is performed by using the liquid crystal having a spontaneous polarization (exhibiting the V-T characteristic shown in FIG. 3) according to frame inversion drive (wherein a data signal voltage is applied while inverting its polarity for each frame), the voltage lowering is caused to provide a voltage decrement ΔV1 (=ΔQ/Clc (1+α)) based on an inversion degree (ΔQ) of the spontaneous polarization, which is basically in proportion to the spontaneous polarization (Ps).

In this instance, assuming that the liquid crystal device provides a transmittance Tc (%) at the point C and a transmittance $T_D$ (%) at the point D and a change in Ps is in accordance with one-order theory, the voltage decrement ΔV1 is determined according to the following equation (3):

$$\Delta V1=\{1/2(Tc/100+T_D/100)\}\times 2Ps\times S/Clc(1+\alpha) \quad (3)$$
$$=\{1/2(Tc/100+T_D/100)\}\times \Delta Vmax1.$$

Accordingly, the voltage decrement ΔV1 by the frame inversion drive can be determined (converted) as a value which is in proportion to the ΔVmax1.

On the other hand, in the case where the frame inversion drive is not performed, e.g., when writing operation from a gradational state (point C shown in FIG. 3) to a gradational state (point E) is performed, a voltage decrement ΔV1 at that time is determined by the following equation (3)':

$$\Delta V1=\{(Tc/T_E)/100)\}\times Ps\times S/Clc(1+\alpha) \quad (3)'$$
$$=\{(Tc/T_E)/100)\}\times \Delta Vmax1',$$

wherein Tc is a transmittance (%) at the point C, $T_E$ is a transmittance (%) at the point E, and ΔVmax1' is a maximum voltage decrement (volt) (in the case of not performing the frame inversion drive) and satisfies $$\Delta V\max\mathbf{1}'=Ps\times S/Clc\ (1+\alpha).$$

Similarly, switching operation from the maximum transmission state (point A) under one (e.g., positive)-polarity voltage application to a state (point F) providing transmittance=0 (%) under no voltage application is performed without effecting the frame inversion drive, an inversion degree of the spontaneous polarization is represented by the formula: ΔQ=Ps×S. Accordingly, the maximum voltage decrement (ΔVmax1') based on the inversion of the spontaneous polarization of the liquid crystal is represented by the formula:

$$\Delta V\max\mathbf{1}'=Ps\times S/Clc(1+\alpha) \quad (3)''.$$

As described above, the voltage decrement ΔV1 in the case of not performing the frame inversion drive can be determined (converted) as a value which is in proportion to the ΔVmax1'.

The liquid crystal exhibiting the V-T characteristic as shown in FIG. 3 (particularly, in the case of antiferroelectric liquid crystal) generally has a very large spontaneous polarization (Ps) of at least 100 ($nC/cm^2$), thus leading to a larger voltage decrement (ΔV1) from the applied data signal voltage (Vs) in the active matrix drive. As a result, a desired gradational (display) state cannot be obtained.

In the liquid crystal apparatus according to the present invention, even when a gate selection period Ton is shorter (smaller) than a switching (response) time of a liquid crystal having a spontaneous polarization in the above-mentioned active matrix drive scheme, drive conditions may appropriately be set so as to compensate a lowering in a holding voltage (by the liquid crystal and storage capacitances) due to the inversion of the spontaneous polarization (switching) of the liquid crystal, thus allowing a quick writing operation of desired data within each frame period.

As is understood from the above-mentioned formulas (1) to (3)", we have found that a voltage (potential) decrement ΔV1 of a pixel electrode due to the spontaneous polarization inversion at the time of switching of the liquid crystal having a spontaneous polarization is (directly) proportional to an amount (ΔQ) of inversion of the spontaneous polarization of the liquid crystal used and the inversion amount ΔQ is substantially (directly) proportional to transmittances in gradational (display) states between which writing operation of the liquid crystal exhibiting a V-T characteristic, e.g., as shown in FIG. 3 is performed. In other words, it has been found that if gradational states before and after the writing operation are determined, a voltage (potential) decrement ΔV1 corresponding to a compensation voltage at that time is also obtained. In the present invention, the compensation voltage is determined by the voltage decrement ΔV1 based on a current display data (state) and a subsequent display data (state) and is superposed on an image (data) signal voltage Vs (i.e., source voltage), thus providing a desired gradational display potential.

Figures 6A, 6B, 6C, 6D:
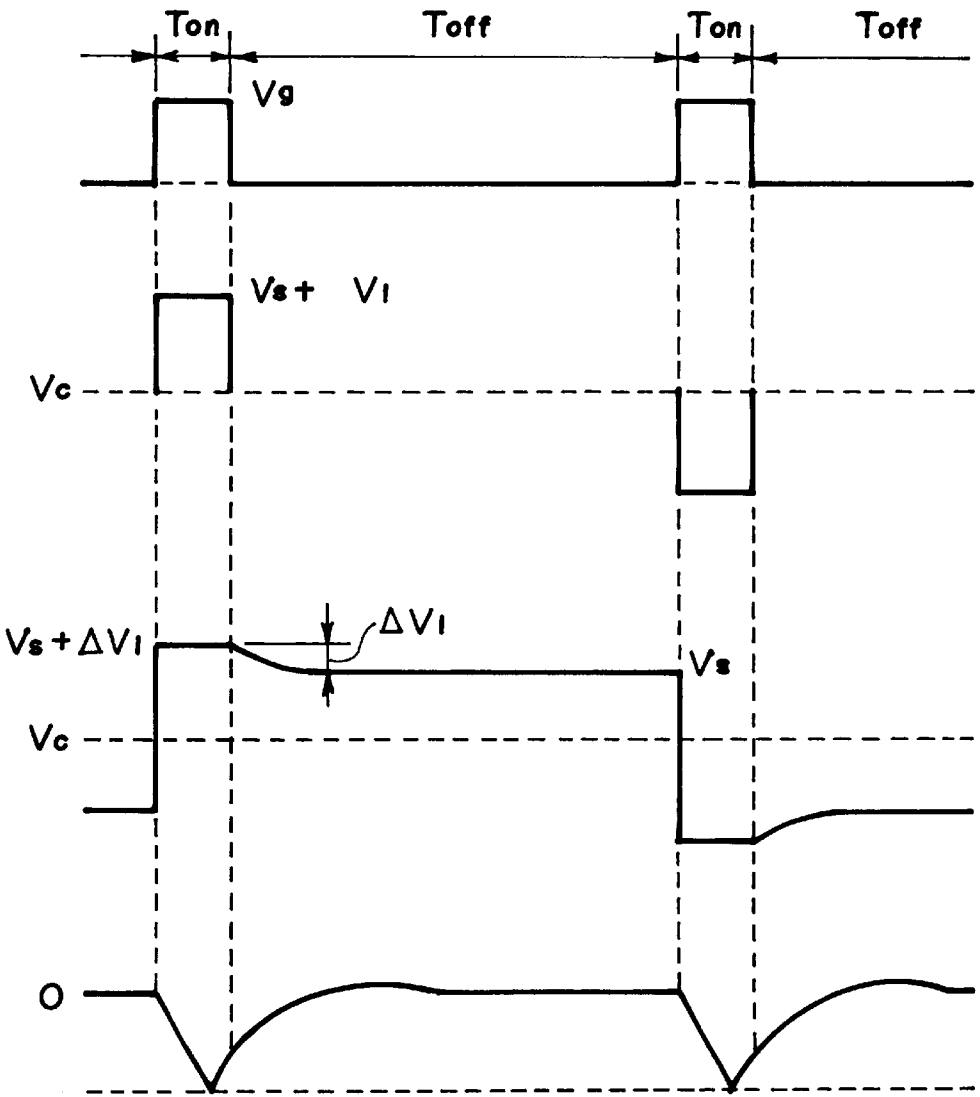
FIGS. 6A–6D and 11A–11D are a scanning signal voltage waveform, a data signal voltage waveform, a voltage waveform applied to a pixel, and an optical response at the pixel, respectively, for an active matrix drive of the liquid crystal apparatus of the present invention.

More specifically, as shown in FIG. 6B, a data signal line (source line) is supplied with a corrected data signal voltage including a compensation voltage (Vs+ΔV1), i.e., an original data signal voltage (Vs) determined from the V-T characteristic as shown in FIG. 3 superposed with a specific voltage decrement (ΔV1) determined depending on prescribed image data (transmittances). As a result, in the selection period Ton, the corrected data signal voltage (Vs+ΔV1) is held at the pixel concerned but, as show in FIG. 6C, is gradually lowered in the subsequent non-selection period Toff with the switching of the liquid crystal (inversion of the spontaneous polarization), thus supplying the liquid crystal layer 49 with the original data signal voltage Vs (as a result of the voltage lowering of ΔV1 from the voltage Vs+ΔV1). Consequently, the original data signal voltage Vs for displaying desired data is applied to the liquid crystal at the pixel in one frame period, thus allowing desired gradational (data) display.

Figure 7:
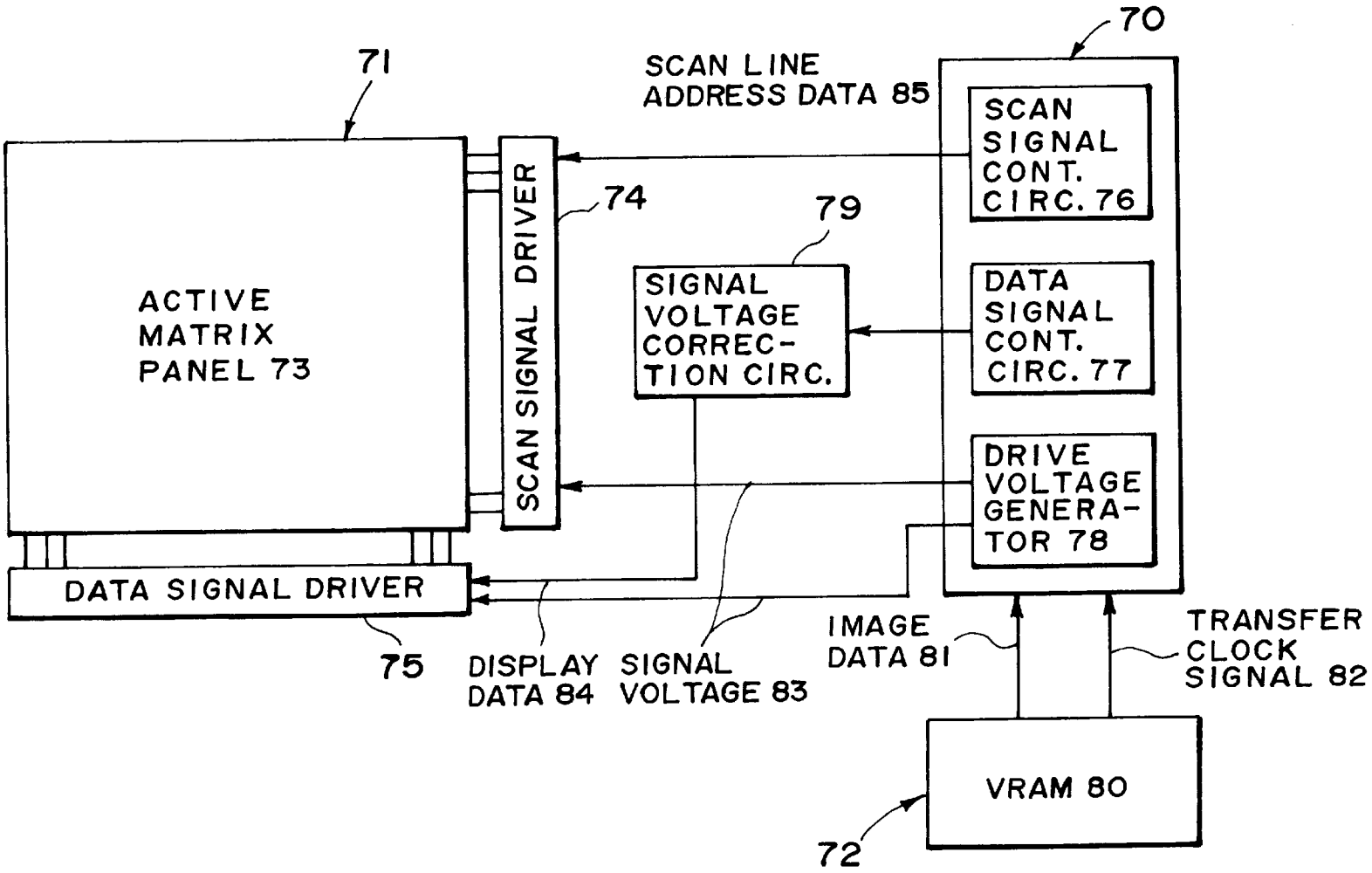
FIGS. 7 and 8 are respectively a block diagram showing the liquid crystal apparatus of the present invention.

FIG. 7 shows an example of a block diagram illustrating the liquid crystal apparatus including a liquid crystal device (panel) and a drive means according to the present invention.

Referring to FIG. 7, the liquid crystal apparatus includes: a controller unit 70, a liquid crystal device (panel) unit 71, a data generator unit 72, an active matrix panel 73, a scanning signal line driver 74, a data signal line driver 75, a scanning signal control circuit 76, data signal control circuit 77, a drive voltage generation circuit 78, a scanning signal correction circuit 79, a video RAM (VRAM) 80, image data 81, a data transfer clock signal 82, a signal voltage 83, display data 84, and scanning signal line address data 85.

In the liquid crystal apparatus shown in FIG. 7, a data signal sent from the data signal control circuit 77 depending on the image data 81 transmitted from the VRAM 81 is corrected by determining a voltage decrement ΔV1 (compensation voltage) by the signal voltage correction circuit 79 depending on its data and its immediately preceding data stored in the controller unit 70 by reference to a V-T characteristic of the liquid crystal as described above. The thus corrected data signal voltage (Vs+ΔV1) as the display data 84 is applied to data signal (source) line(s) via the data signal line diver 75.

Figure 8:
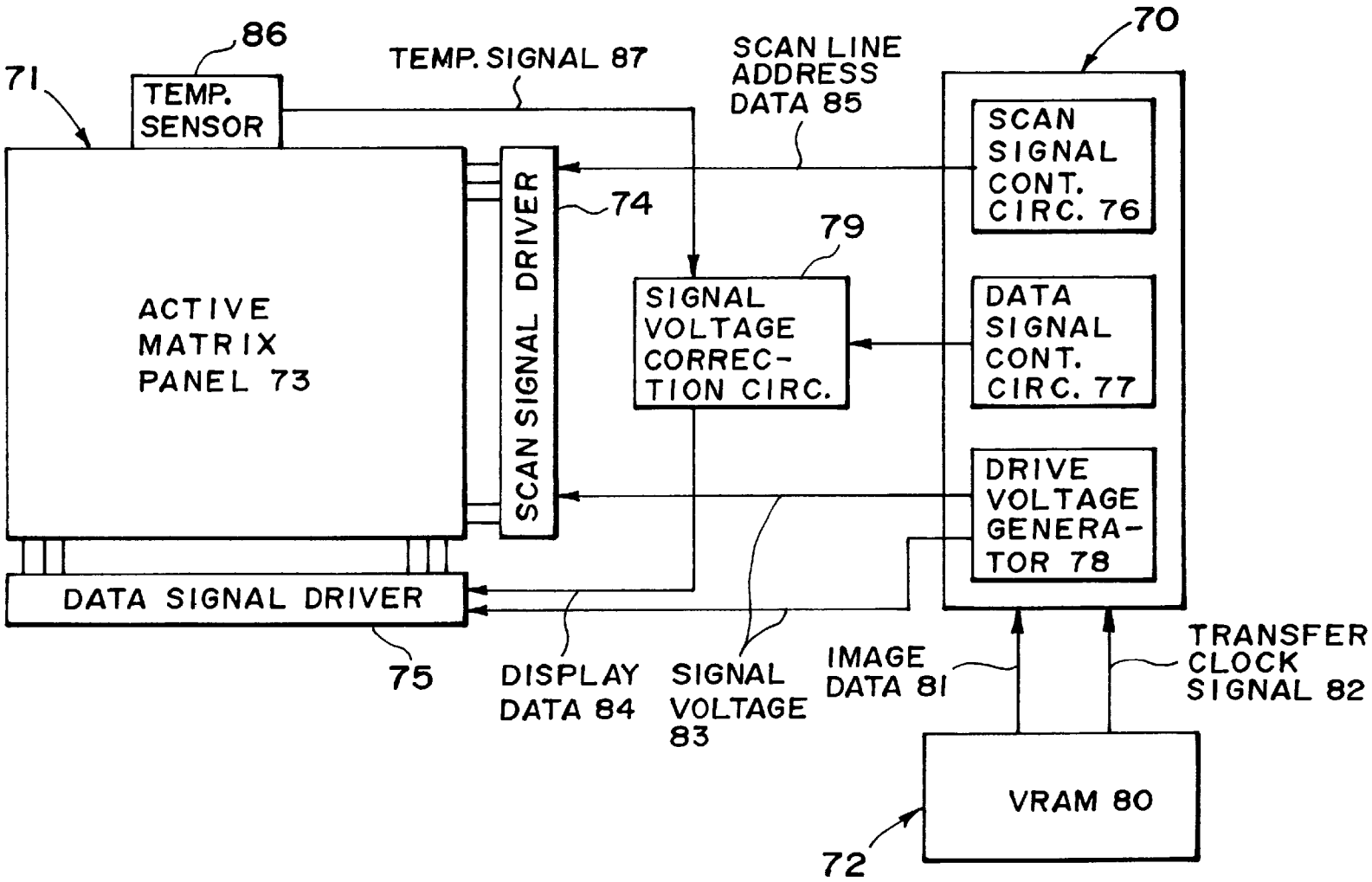

FIG. 8 shows another example of a block diagram of the liquid crystal apparatus of the present invention. The block diagram of the liquid crystal apparatus further includes a temperature sensor 86 and a temperature signal 87 in addition to those for the block diagram of the liquid crystal apparatus shown in FIG. 7.

The liquid crystal having a spontaneous polarization exhibits a property such that a value of the spontaneous polarization (Ps) is lower at a higher temperature and is higher at a lower temperature. Accordingly, an amount (ΔQ) of inversion of the spontaneous polarization at the time of switching in the active matrix drive is fluctuated depending on a change in temperature, thus resulting in a change in voltage decrement (ΔV1) with temperature change or distribution.

In the liquid crystal apparatus shown in FIG. 8, in addition to the voltage decrement correction as a first correction factor as in the case of the liquid crystal apparatus shown in FIG. 7, another correction based on a temperature characteristic (temperature dependence) of the spontaneous polarization is employed as a second correction factor.

More specifically, in addition to the above-mentioned data signal, a temperature signal 87 sent from a temperature sensor 86 is transmitted to the signal voltage correction circuit 79 for the data signal, whereby the temperature characteristic for the drive of the active matrix panel is corrected at the same time, thus allowing a combination of corrections based on the voltage decrement and the temperature characteristic of the spontaneous polarization.

Figure 9:
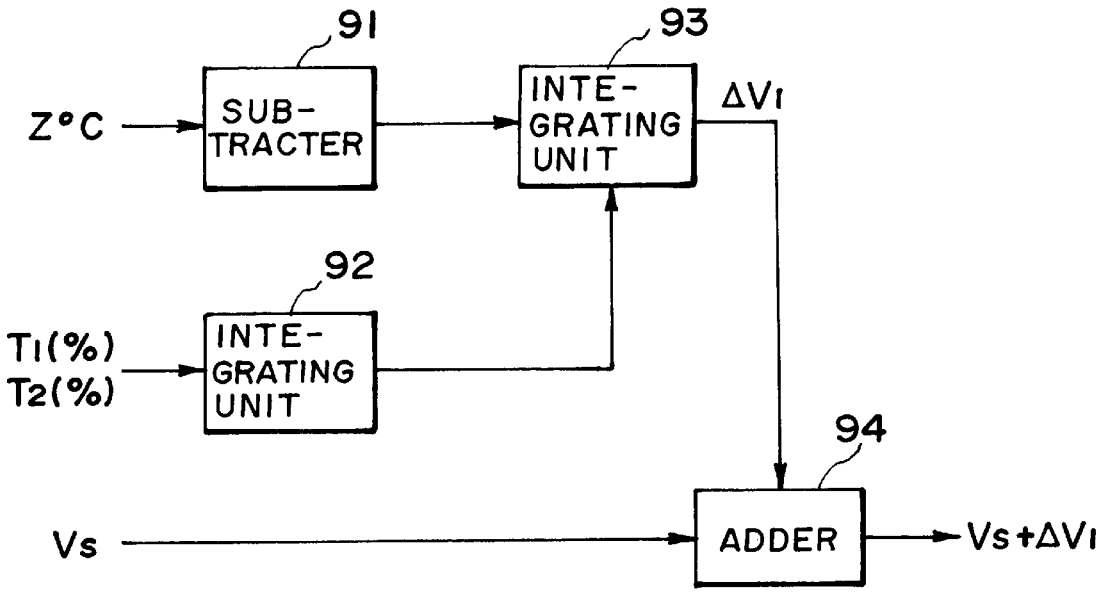
FIG. 9 is a block diagram showing an example of a signal voltage correction circuit used in the liquid crystal apparatus of the present invention.

FIG. 9 shows a block diagram for illustrating a structure of the signal voltage correction circuit 79 used in the liquid crystal apparatus shown in FIG. 8.

Referring to FIG. 9, the correction circuit 79 includes a subtractor 91, integrating units 92 and 93, and an adder 94.

A temperature data (Z° C.) from a temperature sensor provided to the liquid crystal panel is inputted into the substrate 91 to calculate a spontaneous polarization at that temperature. Further, a current display data (transmittance T1 (%)) and a subsequent display data (transmittance T2 (%)) at one pixel concerned are inputted into the integrating unit 92 to calculate an amount of inversion of the spontaneous polarization (at a reference temperature). These data thus obtained (by the subtractor 91 and the integrating unit 92) are set to the integrating unit 93 to determine a voltage decrement ΔV1 at that temperature at the time of writing operation of these data. The voltage decrement ΔV1 and an input (data signal) voltage Vs which is unambiguously determined depending on a V-T characteristic (as shown in FIG. 3) with respect to a subsequent writing data are inputted into the adder 84 to obtain an image data signal (Vs+ΔV1).

The correction circuits 79 (in combination with the temperature sensor 86) as shown in FIGS. 7 and 8 can be additionally incorporated in a conventional TN-type drive circuit, so that it is possible to use a drive circuit (drive means) for the conventional TN-type liquid crystal device in the present invention, thus advantageously reducing production costs for the liquid crystal apparatus according to the present invention.

IN the present invention, the compensation voltage (ΔV1) is in proportion to the inversion amount of the spontaneous polarization as described above, so that it is difficult to effect voltage correction control for each transmittance by a conventional voltage application method for the ordinary TN-type liquid crystal cell (device) wherein a drive voltage is applied across the board to the liquid crystal layer by means of a luminance-adjusting volume.

Second Embodiment

In this embodiment, a voltage decrement in a non-selection period Toff is particularly taken into consideration for displaying a desired gradational state.

As described in First Embodiment, in the case where the liquid crystal device using the liquid crystal having a spontaneous polarization is driven by the active matrix drive scheme as described above, a net voltage decrement ΔV1 (V: volt) for switching of the liquid crystal at one-pixel portion of the liquid crystal layer 49 is is determined according to the following equation (1):

$$\Delta V1=\Delta Q/Clc(1+\alpha)(\alpha=Cs/Clc) \quad (1),$$

wherein ΔQ (C) is an amount of inversion of the spontaneous polarization of the liquid crystal at one pixel, Clc (F) is a liquid crystal capacitance at one pixel, and Cs (F) is a storage capacitance at one pixel.

More specifically, as described above, inversion of spontaneous polarization of a liquid crystal is partially performed in ai selection period Ton although a degree of the inversion varies depending on a liquid crystal material used. In a subsequent non-selection period Toff, a voltage decrement ΔV2 is determined according to the following equation (7):

$$\Delta V2=\{\Delta Q\times M/Clc(1+\alpha)\} \quad (7),$$

wherein M represents a proportion (rate) of polarized (electric) charges incapable of inversion in a scanning selection period of one scanning line depending on writing data for each pixel.

Particularly, in the case of the liquid crystal device providing the V-T characteristic as shown in FIG. 3, when the liquid crystal is switched in its alignment state from a maximum transmission state (point A) under application of one-polarity voltage, e.g., a positive-polarity voltage to another maximum transmission state (point B) under application of the other (opposite)-polarity (e.g., negative-polarity voltage), i.e., when a bright (while) state is continuously displayed in plural frames, the above parameter ΔQ is represented by the formula: ΔQ=2Ps×S where Ps ($C/cm^2$) is a spontaneous polarization intrinsic to the liquid crystal material used and S ($cm^2$) is an (effective) area of the pixel electrode.

Accordingly, a maximum (ΔVmax1:V) for each pixel of the voltage decrement is obtained according to the following equation (2):

$$\Delta V\max 1=2Ps\times S/Clc\ (1+\alpha) \quad (2).$$

Further, a maximum (ΔVmax2) of the voltage decrement ΔV2 in the non-selection period Toff subsequent to the selection period Ton is also obtained by the following equation (8):

$$\Delta V\max 2=2Ps\times S\times M/Clc\ (1+\alpha) \quad (8).$$

Referring again to FIG. 3, when writing operation from a gradational (display) state (point C) to a gradational state (point D) is performed by using the liquid crystal having a spontaneous polarization according to frame inversion drive, the voltage lowering is caused to provide a voltage decrement ΔV2 (=ΔQ×M/Clc (1+α)) based on an inversion degree (ΔQ) of the spontaneous polarization in the period Toff, which is basically in proportion to the spontaneous polarization (Ps).

In this instance, assuming that the liquid crystal device provides a transmittance Tc (%) at the point C and a transmittance $T_D$ (%) at the point D and a change in Ps is in accordance with one-order theory, the voltage decrement ΔV2 is determined according to the following equation (9):

$$\Delta V2=\{1/2(Tc/100+T_D/100)\}\times 2Ps\times S\times M/Clc(1+\alpha) \quad (9)$$
$$=\{1/2(Tc/100+T_D/100)\}\times \Delta Vmax2.$$

Accordingly, the voltage decrement ΔV2 by the frame inversion drive can be determined (converted) as a value which is in proportion to the ΔVmax2.

On the other hand, in the case where the frame inversion drive is not performed, e.g., when writing operation from a gradational state (point C shown in FIG. 3) to a gradational state (point E) is performed, a voltage decrement ΔV2 at that time in the period Toff is determined by the following equation (10):

$$\Delta V2=\{Tc-T_E)/100\}\times Ps\times S\times M/Clc(1+\alpha) \quad (10)$$
$$=\{Tc-T_E)/100\}\times \Delta Vmax2',$$

wherein Tc is a transmittance (%) at the point C, $T_E$ is a transmittance (%) at the point E, and ΔVmax2' is a maximum voltage decrement (volt) (in the case of not performing the frame inversion drive) and satisfies $$\Delta V\max 2'=Ps\times S\times M/Clc\ (1+\alpha).$$

Similarly, switching operation from the maximum transmission state (point A) under one (e.g., positive)-polarity voltage application to a state (point F) providing transmittance=0 (%) under no voltage application is performed without effecting the frame inversion drive, an inversion degree of the spontaneous polarization is represented by the formula: ΔQ=Ps×S. Accordingly, the maximum voltage decrement (ΔVmax2') based on the inversion of the spontaneous polarization of the liquid crystal in the period Toff is represented by the formula:

$$V\max 2'=Ps\times S\times M/Clc(1+\alpha) \quad (11).$$

As described above, the voltage decrement V2 in the case of not performing the frame inversion drive can be determined (converted) as a value which is in proportion to the ΔVmax2'.

The liquid crystal exhibiting the V-T characteristic as shown in FIG. 3 (particularly, in the case of antiferroelectric liquid crystal) generally has a very large spontaneous polarization (Ps) of at least 100 ($nC/cm^2$), thus leading to a larger voltage decrement (ΔV1) from the applied data signal voltage (Vs) in the active matrix drive. As a result, a desired gradational (display) state cannot be obtained.

In the liquid crystal apparatus according to the present invention, even when a gate selection period Ton is shorter (smaller) than a switching (response) time of a liquid crystal having a spontaneous polarization in the above-mentioned active matrix drive scheme, drive conditions and panel structure may appropriately be set to satisfy a formula (12) shown below so as to compensate a lowering in a holding voltage (by the liquid crystal and storage capacitances) due to the inversion of the spontaneous polarization (switching) of the liquid crystal in the non-selection period Toff, thus allowing a quick writing operation of desired data within each frame period.

$$Vs2\geqq\{\Delta Q\times M/(Clc+Cs)\}+Vs1 \quad (12),$$

wherein Vs2 is a data signal voltage (V) applied to one pixel, Vs1 is a voltage (V) for providing writing data for the pixel based on a voltage-transmittance characteristic of the liquid crystal, ΔQ is an amount (C) of inversion of the spontaneous polarization of the liquid crystal, Clc is a liquid crystal capacitance (F) at one pixel, Cs is a storage capacitance (F) at one pixel, and M is a proportion of polarized charges incapable of inversion in a scanning selection period of one scanning line depending on writing data for the pixel.

Herein, the parameter M may also be represented by a portion of the remaining portion of polarity inversion (of the spontaneous polarization of the liquid crystal) in a scanning selection period for an associated scanning signal line.

In an actual liquid crystal panel, when a selection period Ton for one pixel is set to be considerably shorter, it is difficult to complete the switching of liquid crystal (i.e., inversion of the spontaneous polarization) in the period Ton. As a result, most of the switching (inversion) is liable to occur in a subsequent non-selection period Toff (immediately after the Ton). For this reason, in an actual (active matrix) drive, a voltage applied to the liquid crystal layer 49 in the non-selection period Toff is considered to be lowered from a desired voltage level Vs by a voltage decrement ΔV1 which can be closer to the ΔVmax1 as a maximum level.

By appropriately controlling the voltage decrement ΔV1 (or ΔVmax1), it is possible to realize a good gradational display. In further detail, the voltage lowering is caused depending on an amount of electric charges which cannot be inverted in the selection period Ton, so that an accurate voltage decrement in the non-selection period Toff is ΔV2 or ΔVmax2. Accordingly, in order to effect gradational display including accurate gradational level control, it is necessary to control the voltage decrement ΔV2 (or ΔVmax2). In the present invention, the liquid crystal panel structure and/or driving conditions are designed or set so as to fulfill the above-mentioned formula (condition) (12).

As is understood from the above-mentioned formulas (7) to (12), we have found that a voltage (potential) decrement ΔV2 of a pixel electrode due to the spontaneous polarization inversion at the time of switching of the liquid crystal having a spontaneous polarization is (directly) proportional to an amount (ΔQ) of inversion of the spontaneous polarization of the liquid crystal used and the inversion amount ΔQ is substantially (directly) proportional to transmittances in gradational (display) states between which writing operation of the liquid crystal exhibiting a V-T characteristic, e.g., as shown in FIG. 3 is performed. In other words, it has been found that if gradational states before and after the writing operation are determined, a voltage (potential) decrement ΔV2 corresponding to a compensation voltage at that time is also obtained. In the present invention, a voltage Vs2 is applied to the pixel so that the Vs2 is equal to or larger than a voltage (ΔV2+Vs1) determined by superposing the voltage decrement ΔV2 based on a current display data (state) and a subsequent display data (state) on an image (data) signal voltage Vs1 (i.e., source voltage), thus providing a desired gradational display potential.

Herein, the value of M (a proportion of polarized charges incapable of inversion in Ton for one scanning line depending on writing data for a pixel concerned) may be determined unambiguously by current writing data for the pixel concerned and writing data in the (immediately) preceding frame (an average liquid crystal molecular position in the preceding frame). The value of M may vary depending on Ton (scanning selection period) for one scanning line, physical properties (e.g., response time or speed) of the liquid crystal material used, environmental (operation) temperature, etc.

In the case of the frame inversion drive, a minimum M (M=0) is given when a data (signal) voltage for a preceding frame is 0 (V) (providing a minimum transmittance for display a black (dark) state) and a data voltage for a current frame is also 0 (V). Further, a maximum M is given, e.g., when a data voltage for a preceding frame is −V0 (V) (providing a maximum transmittance for displaying a white (bright) state as shown in FIG. 3) and a data voltage for a current frame is V0 (V) (maximum transmittance: white state).

On the other hand, in the case where the frame inversion drive is not performed, a minimum M (M−0) is given, e.g., when both of data voltages for a preceding frame and a current frame, respectively, are 0 (V) (minimum transmittance: black state). Further, a maximum M is given, e.g., when a data voltage for a preceding frame is V0 (V) (maximum transmittance: white state) and a data voltage for a current frame is 0 (V) (minimum transmittance: black state).

Particularly, when the response time (speed) is shorter (slower) and the scanning selection period (Ton) is shorter, the value of M becomes larger and approaches 1 (M=1).

In view of any gradational display levels (including, e.g., back-to-white display, white-to-black display, and halftone-to-halftone display), the value of M determined by the preceding frame data and the current from data may be in the range of $0 \leqq M < 1$. For example, the value of M in Example 4 appearing hereinafter is 0.5 (M=0.5).

Figures 11A, 11B, 11C, 11D:
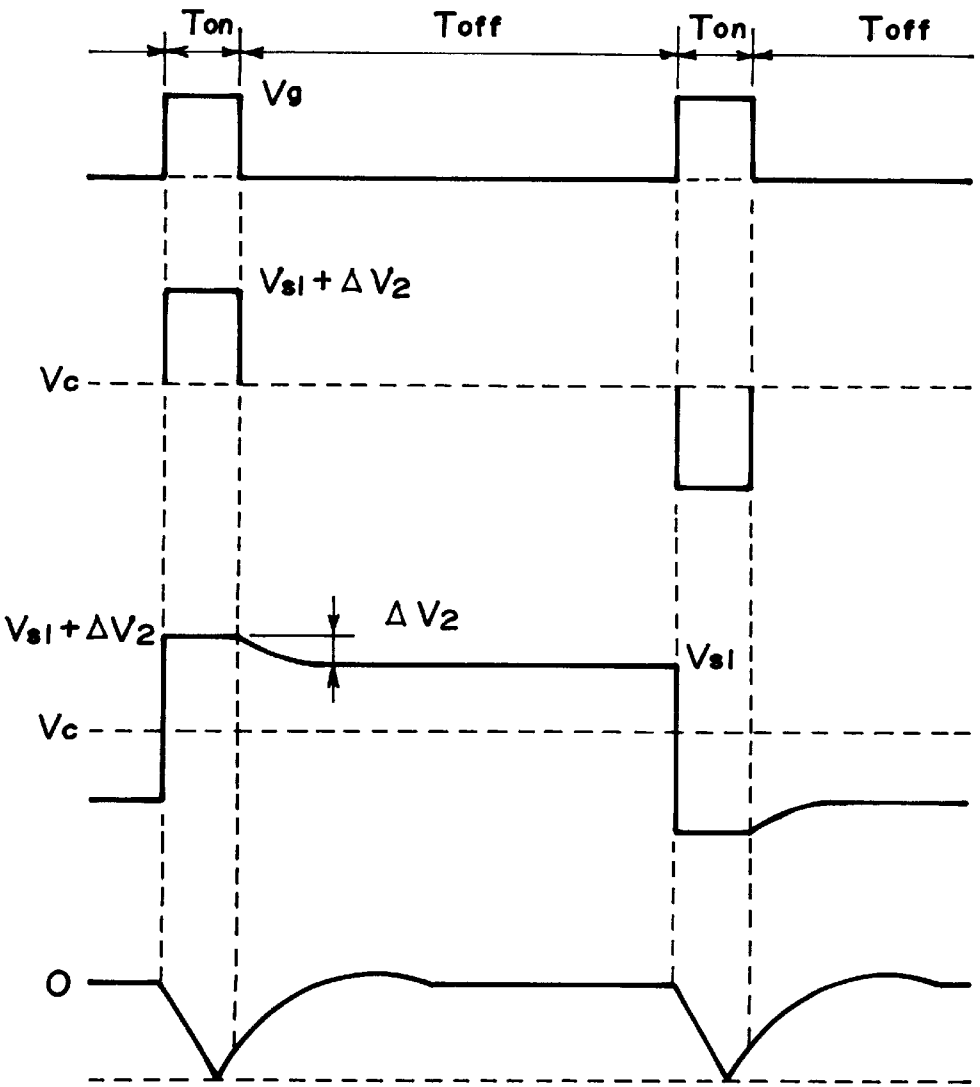

In this (second) embodiment, e.g., as shown in FIG. 1B, a data signal line (source line) is supplied with a corrected data signal voltage including a compensation voltage (Vs+ΔV1), i.e., an original data signal voltage (Vs) determined from the V-T characteristic as shown in FIG. 3 superposed with a specific voltage decrement (ΔV2) determined depending on prescribed image data (transmittances). As a result, in the selection period Ton, the corrected data signal voltage (Vs1+ΔV2) is held at the pixel concerned but, as show in FIG. 11C, is gradually lowered in the subsequent non-selection period Toff with the switching of the liquid crystal (inversion of the spontaneous polarization), thus supplying the liquid crystal layer 49 with the original data signal voltage Vs1 (as a result of the voltage lowering of ΔV2 from the voltage Vs1+ΔV2). Consequently, the original data signal voltage Vs1 for displaying desired data is applied to the liquid crystal at the pixel in one frame period, thus allowing desired gradational (data) display.

In this (second) embodiment, similarly as in First Embodiment, the liquid crystal apparatus may be driven by using drive (control) means as described with reference to FIGS. 7, 8 and 9. More specifically, it is possible to effect correction of a data signal voltage applied to the pixel (liquid crystal layer) based on a voltage decrement or a combination of a voltage decrement with a temperature change (distribution) of the spontaneous polarization (Ps).

Third Embodiment

In this embodiment, the number of gradational levels and a fluctuation in total capacitance (Clc+Cs) within a liquid crystal cell are particularly taken into consideration for effecting a good gradational display.

More specifically, also in this embodiment, as shown in FIG. 6B, a data signal line (source line) is supplied with a corrected data signal voltage including a compensation voltage (Vs+ΔV1), i.e., an original data signal voltage (Vs) determined from the V-T characteristic as shown in FIG. 3 superposed with a specific voltage decrement (ΔV1) determined depending on prescribed image data (transmittances). As a result, in the selection period Ton, the corrected data signal voltage (Vs+ΔV1) is held at the pixel concerned but, as show in FIG. 6C, is gradually lowered in the subsequent non-selection period Toff with the switching of the liquid crystal (inversion of the spontaneous polarization), thus supplying the liquid crystal layer 49 with the original data signal voltage Vs (as a result of the voltage lowering of ΔV1 from the voltage Vs+ΔV1). Consequently, the original data signal voltage Vs for displaying desired data is applied to the liquid crystal at the pixel in one frame period, thus allowing desired gradational (data) display.

As mentioned above, in the case where the liquid crystal device using the liquid crystal having a spontaneous polarization is driven by the active matrix drive scheme as described above, a net voltage decrement ΔV1 (V: volt) for switching of the liquid crystal at one-pixel portion of the liquid crystal layer 49 is given by the inversion of the spontaneous polarization of the liquid crystal and is determined according to the following equation (1):

$$\Delta V1=\Delta Q/(Clc+Cs) \quad (1),$$

wherein ΔQ (C) is an amount of inversion of the spontaneous polarization of the liquid crystal at one pixel, Clc (F) is a liquid crystal capacitance at one pixel, and Cs (F) is a storage capacitance at one pixel.

Particularly, in the case of the liquid crystal device providing the V-T characteristic as shown in FIG. 3, when the liquid crystal is switched in its alignment state from a maximum transmission state (point A) under application of one-polarity voltage, e.g., a positive-polarity voltage to another maximum transmission state (point B) under application of the other (opposite)-polarity (e.g., negative-polarity voltage), i.e., when a bright (while) state is continuously displayed in plural frames, the above parameter ΔQ is represented by the formula: ΔQ=2Ps×S where Ps ($C/cm^2$) is a spontaneous polarization intrinsic to the liquid crystal material used and S ($cm^2$) is an (effective) area of the pixel electrode.

Accordingly, a maximum (ΔVmax1:V) of the voltage decrement is obtained according to the following equation:

$$\Delta V\max 1=2Ps\times S/(Clc+Cs).$$

In an actual liquid crystal panel, a selection period Ton for one pixel is shorter, so that it is difficult to complete the switching of liquid crystal (i.e., inversion of the spontaneous polarization) in the period Ton. As a result, most of the switching (inversion) is liable to occur in a subsequent non-selection period Toff (immediately after the Ton). For this reason, in an actual (active matrix) drive, a voltage applied to the liquid crystal layer 49 in the non-selection period Toff is considered to be lowered from the prescribed voltage level Vs by a voltage decrement ΔV1 which can be closer to the ΔVmax1 as a maximum level.

For example, in the case of effecting the above-mentioned switching from the point A to the point C (shown in FIG. 3), a voltage consisting of a saturation voltage V0 of the liquid crystal (a voltage providing a maximum transmittance in a state (DC) drive corresponding to V0 shown in FIG. 3) superposed with the above-mentioned ΔV1 (or ΔVmax1) is applied to the liquid crystal layer 49.

As apparent from the above formulas (1) and (2), ΔV1 (ΔVmax1) is changed depending on the total capacitance (Clc+Cs) within the liquid crystal cell. In the actual liquid crystal panel, each of the liquid crystal capacitance Clc and the storage capacitance inevitably causes a fluctuation (or distribution) from its set value for each pixel in view of the production process. As a result, the total capacitance (Clc+Cs) also causes a distribution of its value over the entire liquid crystal cell to provide a maximum value ((Clc+Cs)max) and a minimum value ((Clc+Cs)min).

If a fluctuation in ΔV1 (voltage decrement) based on (Clc+Cs)max and (Clc+Cs)min is within a voltage fraction for one gradational level, gradational display is little affected. More specifically, when gradation display (for displaying n gradational levels) is performed by applying a voltage in the range of 0 (V) to V0 (V) the (Clc+Cs)max and the (Clc+Cs)min may preferably satisfy the following relationship (13):

$$(V0-0)/(n-1)>\{2Ps\times S/(Clc+Cs)\min-2Ps\times S/(Clc+Cs)\max\},$$

i.e., $$V0/(n-1)>2Ps\times S\{1/(Clc+Cs)\min-2/(Clc+Cs)\max\},$$

i.e., $$1/(n-1)>\{2Ps\times S/V0\}\times\{1/(Clc+Cs)\min-1/(Clc+Cs)\max\} \quad (13)$$

In the relationship (13), the latter parameter {1/(Clc+Cs)min−1/(Clc+Cs)max} may be approximated as follows:

$$\{(Clc+Cs)\max-(Clc+Cs)\min\}/\{(Clc+Cs)\text{ave}\}^2,$$

where (Clc+Cs)ave represents an average of (Clc+Cs) within the liquid crystal cell.

Here, assuming that a capacitance distribution factor (A) within the liquid crystal cell is represented by the equation:

$$A=\{(Clc+Cs)\max-(Clc+Cs)\min\}/(Clc+Cs)\text{ave},$$

the above formula (13) is represented by the following formula (14):

$$1/(n-1)>A(2Ps\times S)/V0(Clc+Cs)\text{ave} \quad (14).$$

In this (third) embodiment, the liquid crystal material used and the liquid crystal cell structure employed may appropriately selected so as to satisfy the above formula (14), whereby a good gradational display can be performed.

Further, in this (third) embodiment, similarly as in First Embodiment, the liquid crystal apparatus may be driven by using drive (control) means as described with reference to FIGS. 7, 8 and 9. More specifically, it is possible to effect correction of a data signal voltage applied to the pixel (liquid crystal layer) based on a voltage decrement or a combination of a voltage decrement with a temperature change (distribution) of the spontaneous polarization (Ps). Further, in this embodiment, it is also possible to drive the liquid crystal apparatus by a drive scheme without effecting frame inversion of a polarity of an applied voltage.

Figure 14:
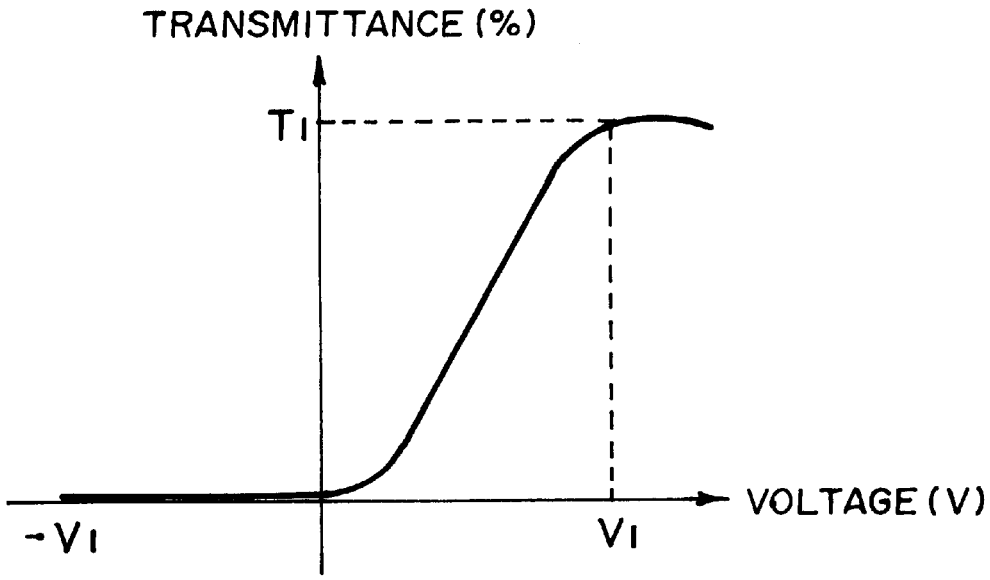
FIGS. 14 and 15 are respectively another voltage-transmittance characteristic of a liquid crystal used in the present invention.

In the present invention, a liquid crystal device having a voltage (V)—transmittance (T) characteristic as shown in FIG. 14 can also be applied to First to Third Embodiments for the liquid crystal apparatus according to the present invention to attain similar effects as obtained by using a liquid crystal device having a voltage (V)—transmittance (T) characteristic as shown in FIG. 3.

A liquid crystal device having a V-T characteristic shown in FIG. 14 can be formed by using a liquid crystal material having a spontaneous polarization and exhibiting a chiral smectic phase, of which the composition is adjusted to preferably contain at most 50 wt. % of compounds having an ester skeleton, and further by appropriate adjustment of the liquid crystal material treatment, the device structure including a material, and a treatment condition for alignment control films. More specifically, the V-T characteristic of FIG. 14 is realized by a liquid crystal device wherein the liquid crystal molecules are aligned to provide an average molecular axis substantially coinciding with an average uniaxial aligning treatment axis to be mono-stabilized in the absence of an electric field applied thereto and, under application of voltages of one polarity (a first polarity), are realigned to provide a tilt angle which varies continuously from the average molecular axis of the monostabilized position depending on the magnitude of the applied voltage, but under application of voltages of the other polarity (i.e., a second polarity opposite to the first polarity), the liquid crystal molecules are not substantially tilted but provide an average molecular axis substantially coinciding with the average molecular axis under no electric field regardless of the magnitude of the applied voltages. The liquid crystal material (having a spontaneous polarization and showing a chiral smectic phase) may preferably exhibit a phase transition series on temperature decrease of I (isotropic) phase—Ch (cholesteric) phase—SmC* (chiral smectic) phase or I phase—SmC* phase and be placed in a non-memory state in the SmC* phase.

Figure 15:
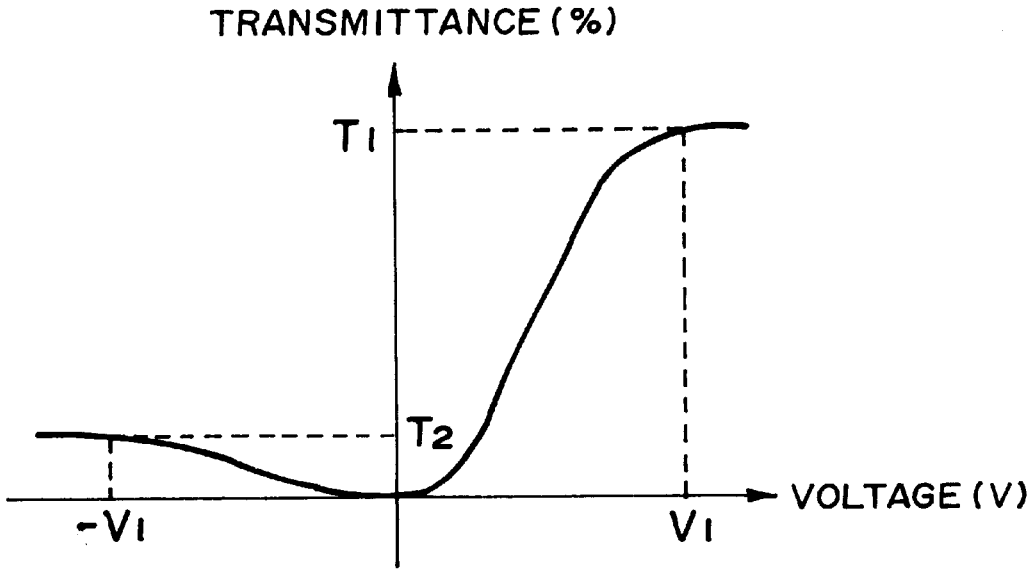

Further, a liquid crystal device having a voltage (V)—transmittance (T) characteristic as shown in FIG. 15 can also be applied to First to Third Embodiments for the liquid crystal apparatus according to the present invention to attain similar effects as obtained by using a liquid crystal device having a voltage (V)—transmittance (T) characteristic as shown in FIG. 3.

A liquid crystal device having a V-T characteristic shown in FIG. 15 can be formed by using a liquid crystal material having a spontaneous polarization and exhibiting a chiral smectic phase, while adjusting the composition thereof, and further by appropriate adjustment of the liquid crystal material treatment, the device structure including a material, and a treatment condition for alignment control films. More specifically, the V-T characteristic of FIG. 15 is realized by a liquid crystal device wherein the liquid crystal molecules are aligned to provide an average molecular axis substantially coinciding with an average uniaxial aligning treatment axis to be mono-stabilized in the absence of an electric field applied thereto and, under application of voltages of one polarity (a first polarity), are realigned to provide a tilt angle which varies continuously from the average molecular axis of the monostabilized position depending on the magnitude of the applied voltage. On the other hand, under application of voltages of the other polarity (i.e., a second polarity opposite to the first polarity), the liquid crystal molecules are tilted from the average molecular axis under no electric field depending on the magnitude of the applied voltages, but the maximum tilt angle obtained under application of the second polarity voltages is substantially smaller than the maximum tilt angle formed under application of the first polarity voltages. The liquid crystal material (having a spontaneous polarization and showing a chiral smectic phase) may preferably exhibit a phase transition series on temperature decrease of I phase—Ch phase—SmC* phase or I phase—SmC* phase and be placed in a non-memory state in the SmC* phase.

EXAMPLE 1

A liquid crystal panel for active matrix drive including a plurality of TFTs as shown in FIG. 1 and a plurality of pixels (100×100 pixels) each having a structure as shown in FIG. 2 was prepared in accordance with an ordinary production process therefor.

More specifically, referring to FIG. 2 for each pixel, with respect to an active matrix plate 20, an a-Si (amorphous silicon) TFT 14 including a gate insulation film 23 of silicon nitride was used as a TFT and an ITO film was used as a pixel electrode 15. A storage capacitance 32 was constituted by the pixel electrode 15, a storage capacitance electrode 30 of ITO, and the gate insulation (silicon nitride) film 23 disposed between the electrodes 15 and 30 so that it had a capacitance (Sc) which was 20 times a liquid crystal (pixel) capacitance (Clc). On the TFT 14 and the pixel electrode 15, a 20 nm-thick alignment film 43*a* of aliphatic polyimide resin was formed and subjected to a rubbing (uniaxial aligning) treatment, thus preparing an active matrix plate.

A counter plate 40 was prepared by forming a 20 nm-thick alignment film 43*b* of aliphatic polyimide resin on an alkaline glass substrate 41 entirely coated with a common electrode 42 of ITO, followed by rubbing treatment for uniaxial alignment.

On the counter plate 40, spacer beads having an average particle size of 2 $\mu$m were dispersed, and the active matrix plate 20 was superposed to prepare a blank cell.

As gap of the blank cell (between the substrates 20 and 40) was filled with a chiral smectic liquid crystal 49 having a spontaneous polarization and exhibiting a voltage-transmittance (V-T) characteristic (as shown in FIG. 3 at the time of voltage application of a rectangular waveform) in accordance with an ordinary process (vacuum injection under heating), thus preparing a liquid crystal panel (device) for active matrix drive scheme having 10,000 (100×100) pixels.

The chiral smectic liquid crystal showed a spontaneous polarization (Ps) of ca. 40 nC/cm at 30° C. as measured by the triangular wave method. The liquid crystal capacitance (Clc) per unit area 31 between the pixel electrode 15 and the common electrode 42 was set to ca. 1.77 nF/cm . The pixel electrode 15 (for one pixel) had an area of 300 $\mu$m×100 $\mu$m and an opening rate of 70%, thus providing an effective spontaneous polarization (S) of 300 $\mu$m×100 $\mu$m×0.7=2.1×$10^{-4}$ $cm^2$.

The resultant liquid crystal panel showed a V-T characteristic under application of a rectangular wave (60 Hz) as shown in FIG. 3 wherein a transmittance was substantially linearly increased from 0% (at 0 volt: point F) to 100% (at a saturation voltage V0 (at 30° C.)=ca. 4 volts: point A). This V-T characteristic was not substantially changed in a temperature range of 10–45° C. At further high temperatures, a tilt angle of the chiral smectic liquid crystal used as decreased to lower a resultant transmittance (T) but the gradient (slope) of the V-T curve was not substantially changed.

As apparent from Table 1 (shown above and employing the same S and Clc), when Ps=40 nC/$cm^2$ and $\alpha$(Cs/Clc)=20, a maximum voltage decrement $\Delta$Vmax1 is 2.15 (volt) at the time of switching between the point A and the point B each providing a maximum transmission state.

In this example, a voltage decrement ($\Delta$V1R) for respective gradational (display) levels may be approximately represented by a formula (4) shown below based on the above-mentioned formula (3) and a linearity of the change in transmittance between 0 (V) and 2.15 (V) (=V0).

$$\Delta V1R\ (\text{volt}) = 2.15\ (\text{volt}) \times \text{transmittance}\ (\%)/100 \qquad (4).$$

A liquid crystal apparatus including the above-prepared liquid crystal panel (device) and drive means arranged and designed to have a structure as shown by the block diagram of FIG. 7 was prepared so that a signal voltage correction circuit 79 was set to supply a data signal voltage including the voltage decrement $\Delta$V1R according to the formula (4) depending on a prescribed image data (transmittance).

When the liquid crystal apparatus as shown in FIG. 7 was driven by using driving waveforms as shown in FIGS. 6A–6C (one horizontal scanning selection period (Ton)=16 $\mu$sec, frame frequency=60 Hz) in the active matrix drive scheme, it is possible to provide a transmittance of 100% as in the case of rectangular wave voltage application and also provide desired gradational levels (transmission states).

EXAMPLE 2

A liquid crystal apparatus was prepared in the same manner as in Example 1 except that the drive means (as shown in FIG. 7) was changed to that shown in FIG. 8 including a signal voltage correction circuit 79 as specifically show in FIG. 9.

The liquid crystal used (the same as in Example 1) showed the following temperature characteristic (dependence) of a spontaneous polarization (Ps), wherein the Ps was relatively linearly changed in an operation temperature range.

| Temp. (° C.) | Ps (nC/cm$^2$) |
|---|---|
| 50 | 31 |
| 30 | 40 |
| 10 | 52 |

As apparent from above, the Ps value is increased on temperature decrease at a rate of ca. 0.5 (nC/cm$^2$) per 1° C., thus being represented by the following formula (5):

$$Ps\ (nC/\mathrm{cm}^2)=40+(½)\times(30-Z) \quad (5),$$

wherein Z represents an operation temperature.

On the other hand, at the respective temperature, as is understood from the formulas (1), (3) and (3)' in First Embodiment described above, the voltage decrement ΔV1 is always in proportion to ΔQ (inversion amount of Ps).

In this example, the signal voltage correction circuit 79 as show in FIGS. 8 and 9 was designed and set so that a corrected data signal supplied therefrom was determined based on an additional (second) correction factor according to the formula (5) (temperature characteristic of Ps) in addition to the (first) correction factor according to the formula (4) (the voltage decrement correction by a transmittance), thus further accurately providing desired gradational levels.

According to this example, the signal voltage correction circuit 79 can provide a corrected voltage signal based on a first correction (voltage) signal sent from the data signal control circuit 77 and a second correction (temperature) signal set from the temperature sensor 86 in combination. This corrected voltage signal from the correction circuit 79 is determined based on linear functions, so that the correction circuit 79 can result in a simplified circuit and also is applicable to a drive circuit system (means) of the conventional TN-type liquid crystal apparatus as an additional circuit, thus advantageously reducing production costs.

EXAMPLE 3

A liquid crystal apparatus was prepared in the same manner as in Example 1 except that the liquid crystal device (panel) was prepared by using the following materials and conditions:

α(*Cs*/*Clc*): 3,

Alignment film: aromatic polyimide film,

Spacer beads: 1.4 μm dia.,

Liquid crystal composition: principally comprising pyrimidine skeleton-based liquid crystal compounds, and Ps: 2.5 nC/cm$^2$.

When the liquid crystal device was subjected to measurement of transmittance in combination with a pair of polarizers arranged to provide the darkest state under no voltage application by changing a source voltage while applying a DC voltage to gate lines, the resultant V-T characteristic was that shown in FIG. 3 with 0=3 (volts) and −V0=−3 (volts).

In this example, a maximum voltage decrement ΔVmax1 according to the above-mentioned formula (2) (in First Embodiment) was calculated as ΔVmax1=0.71 (V). Accordingly, a voltage decrement ΔV1R for respective gradational levels due to inversion of spontaneous polarization at the pixel electrode portion was approximately represented by the following formula (6):

$$\Delta V1R=0.71\ (\mathrm{V})\times\text{transmittance}\ (\%)/100 \quad (6).$$

When the liquid crystal was driven similarly as in Example 1, it was possible to effect good gradational display.

COMPARATIVE EXAMPLE 1

A liquid crystal apparatus was prepared in the same manner as in Example 1 and was driven in the same manner as in Example 1 except that the drive voltage (V0=4 (V) as shown in FIG. 3) was applied without effecting correction of the voltage decrease as in the case of the conventional TN-type liquid crystal apparatus.

The thus-driven liquid crystal apparatus caused a maximum voltage decrement (ΔVmax1) of 2.15 (V), thus providing a display state providing a transmittance below ca. 50% even if the maximum voltage (V0=4 (V)) for providing a transmittance of 100% was applied.

As a result, the liquid crystal apparatus failed to effect a good gradational display for displaying desired gradational levels.

As described above, according to the liquid crystal apparatus of the present invention prepared in Examples 1–3, a lowering in transmittance caused by a potential (voltage) drop (lowering) of the pixel electrode due to inversion of the spontaneous polarization of the liquid crystal used was accurately corrected by a simple correction means or circuit, thus providing a prescribed (original) higher transmittance.

Further, the corrected data signal voltage to be applied can be obtained by approximate calculation based on a combination of simple linear functions without using a table reference method with an expensive memory, thus resulting in a simple correction circuit leading to cost reduction of the resultant liquid crystal apparatus.

Further, the liquid crystal apparatus of the present invention may be constituted by using a ferroelectric liquid crystal having a smaller spontaneous polarization instead of the antiferroelectric liquid crystal having a larger spontaneous polarization. In this case, it may be possible to attain the similar results as in Example 1–3.

EXAMPLE 4

Liquid crystal panels for active matrix drive each including a plurality of TFTs as shown in FIG. 1 and a plurality of pixels (320×240 pixels) each having a structure as shown in FIG. 2 was prepared in accordance with an ordinary production process therefor.

More specifically, referring to FIG. 2 for each pixel, with respect to an active matrix plate 20 for each liquid crystal panel, an a-Si (amorphous silicon) TFT 14 including a gate insulation film 23 of silicon nitride was used as a TFT and an ITO film (300 μm×100 μm for each pixel) was used as a pixel electrode 15. A storage capacitance 32 for each pixel was constituted by the pixel electrode 15, a storage capacitance electrode 30 of ITO, and the gate insulation (silicon nitride) film 23 (0.3 μm-thick) disposed between the electrodes 15 and 30.

In this example, an areal ratio between the storage capacitance electrode and the pixel electrode was changed for respective liquid crystal panels in a range of 1:20 to 18:20, thus providing a plurality of storage capacitances different in capacitance value. Further, each of the pixel electrodes had an opening rate of 70% for each pixel (corr. to one bit) and the respective pixel electrodes were arranged with a pitch of 300 μm.

On the TFT 14 and the pixel electrode 15, a 20 nm-thick alignment film 43*a* of a polyimide prepared by using a polyacid acid ("LP-64", mfd. by Toray K.K.) dissolved in NMP (N-methylpyrrolidone) was formed and subjected to a rubbing (uniaxial aligning) treatment, thus preparing an active matrix plate 20 provided with different storage capacitances.

A counter plate 40 was prepared by forming a 20 nm-thick alignment film 43*b* of the same polyimide resin (as in the active matrix plate 20) on a glass substrate 41 entirely coated with a common electrode 42 of ITO, followed by rubbing treatment for uniaxial alignment.

On the counter plate 40, spacer beads having an average particle size of 2.2 μm were dispersed at a density of 300 (particles)/mm$^2$, and the active matrix plate 20 was superposed to prepare a blank cell.

As gap of the blank cell (between the substrates 20 and 40) was filled with a chiral smectic liquid crystal 49 having a spontaneous polarization and exhibiting a voltage-transmittance (V-T) characteristic (as shown in FIG. 3 at the time of voltage application of a rectangular waveform) in accordance with an ordinary process (vacuum injection under heating), thus preparing liquid crystal panels (devices) for active matrix drive scheme each having 320×240 pixels (corr. to the number of storage capacitances) but having capacitance values different for the respective liquid crystal panels.

In each liquid crystal panel, the chiral smectic liquid crystal showed the following phase transition series and physical (electrical) properties.

Phase transition temperature (° C.)

$$\text{Cry} \xrightarrow{-11} \text{SmC}^* \xrightarrow{86} \text{SmA} \xrightarrow{115} \text{Iso}$$

Cry: crystal phase,
SmC*: chiral smectic C phase,
SmA: smectic A phase, and
Iso: isotropic phase.

Tilt angle Ⓗ (30° C.)=29.1 degrees.

Spontaneous polarization Ps (30° C.)=91.2 nc/cm$^2$.

Relative dielectric constant $\in_r$=5.

The resultant liquid crystal panel provided a saturation voltage V0 of 5 volts when measured in a similar manner as in Example 1 with respect to its V-T characteristic as shown in FIG. 3.

As described above, the liquid crystal panel was prepared to provide the following parameters:

Ps=91.2 nC/cm$^2$,

S=300 μm×100 μm×0.7 (opening rate 70%),

Vs2=5 (V),

Clc=0.465 pF (obtained from the pixel electrode area (S), the thickness of the liquid crystal layer of 2.0 μm and the relative dielectric constant of the liquid crystal ($\in_r$) of 5), Cs=0.217–3.91 pF (obtained from the storage capacitance electrode area (S/20 to 0.9S), the thickness (0.3 μm) of the dielectric material layer (gate insulation film), a relative dielectric constant of the dielectric material layer of 7), Clc+Cs=0.68–4.38 pF (varied).

The liquid crystal panels having different storage capacitances were each driven in an active matrix drive scheme with interlaced scanning by using driving waveforms shown in FIGS. 11A–11C under the following conditions:

frequency: 60 Hz,

Vs100 (a data signal (drive) voltage for providing a transmittance of 100%)=±10 (V), Vs0 (a data signal voltage for providing a transmittance of 0%)=0 (V), Vg (gate voltage)=+15 (V), Ton (gate (scanning) selection period)=20 μsec.

In these conditions, the liquid crystal material used showed a response time (a time required for causing switching between point A (T=100%) and point B (T=100%) as shown in FIG. 3) of 200 μsec. Further, within the gate selection period (Ton), the liquid crystal material having the spontaneous polarization used in this example causes about a half polarity inversion thereof (i.e., M÷0.5 in the formula (12) described above).

Figure 12:
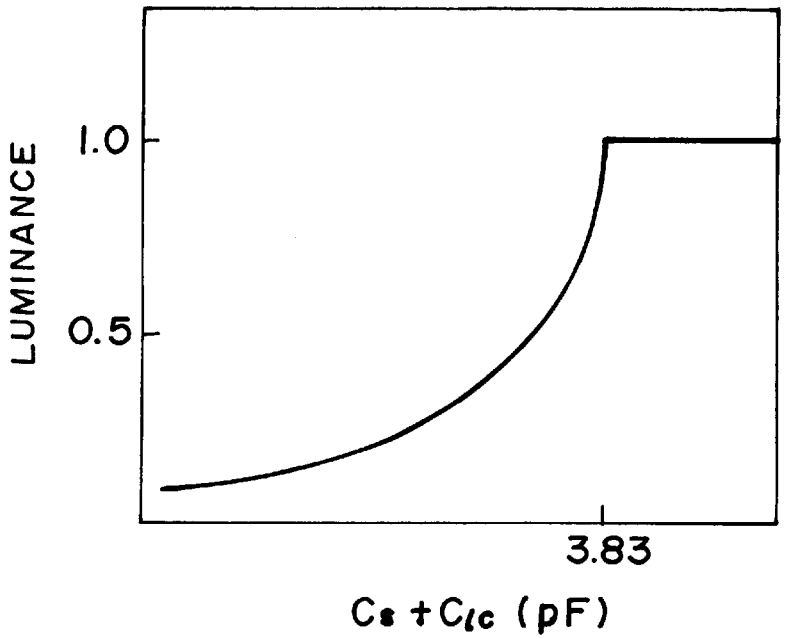
FIG. 12 is a graph showing a relationship between total of a liquid crystal capacitance and a storage capacitance and a luminance (transmittance) for displaying a whole white image.

When these liquid crystal panels were driven for displaying the whole white state, the liquid crystal panels showed a relationship between total capacitances (Clc+Cs) changed for the respective liquid crystal panels and corresponding luminances (wherein an ideal transmittance (luminance) providing the whole white state based on the tilt angle (29.1 deg.) of the liquid crystal used was taken as 1.0) in FIG. 12.

As apparent from FIG. 12, it is possible to attain an objective transmittance for the liquid crystal (i.e., a maximum transmittance based on the tilt angle Ⓗ of 29.1 deg.) by setting the Cs to satisfy the relationship: (Clc+Cs)≧3.83 (since the Clc is a certain value determined based on the liquid crystal material, the pixel electrode area and the cell thickness).

In this example, when the relationship: (Clc+Cs)≧3.83 is fulfilled, the above-mentioned formula (12) (Vs2≧{ΔQ×M/(Clc+Cs)}+Vs1) is also satisfied.

Further, in this example (Example 4), the storage capacitances (Cs) were changed. In an ordinary liquid crystal display panel using TFTs, a storage capacitance may generally be constituted by an insulation film (which is formed in a common step together with a gate insulation film of SiNx (relative dielectric constant=7)) and a pair of a pixel electrode and a storage capacitance electrode sandwiching the insulation film, thus generally providing a minimum thickness of ca. 300 nm. In this case, assuming that an electrode for constituting the Cs has a maximum area when an areal ratio of the storage capacitance electrode to the pixel electrode is 0.9:1, the resultant Cs has an upper limit value of ca. 4.37 (pF). Further, in the case where the gate selection period (Ton) is sufficiently shorter than the response time of the liquid crystal, the resultant M nearly equal to 1.

Further, as driver ICs for the liquid crystal apparatus, CMOS (complementary metal-oxide semiconductor)-type driver ICs providing a maximum drive voltage of ±10 (V) are preferentially used in view of reductions in size and power consumption therefor. Accordingly, in the formula (12) in the present invention, a spontaneous polarization voltage Vs2 may preferably have a maximum of at most ±10 (V).

In addition, taking a minimum saturation voltage (V0: a voltage providing a maximum tilt angle of the liquid crystal)

for a ferroelectric or anti-ferroelectric liquid crystal of ca. 2 (V) into consideration with respect to the formula (12), the liquid crystal material used is required to have a spontaneous polarization always satisfying Ps<83.4 nC/cm$^2$. Even if some fluctuation factors (e.g., a relative dielectric constant and a saturation voltage of the liquid crystal, thicknesses of structural members of TFT and Cs, and a drive voltage) is further taken into consideration, the liquid crystal material is required to have a spontaneous polarization satisfying Ps<100 nC/cm$^2$ in order to ensure a good luminance and a high contrast.

EXAMPLE 5

Liquid crystal panels were prepared in the same manner as in Example 4 except that a storage capacitance (Cs) was set to 4.0 pF (constant) and driven in the same manner as in Example 4 except that drive voltages the respective liquid crystal panels were changed, thus effecting a display for the whole white state.

Figure 13:
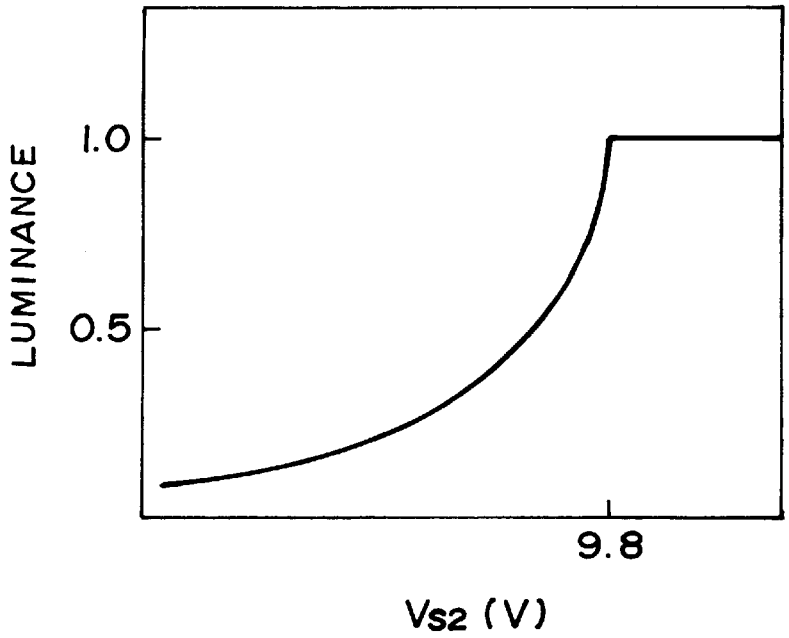
FIG. 13 is a graph showing a relationship between a drive voltage and a luminance for displaying a whole white image.

The liquid crystal panels showed a relationship between drive voltage (Vs2) changed for the respective liquid crystal panels and corresponding luminances (wherein an ideal transmittance (luminance) providing the whole white state based on the tilt angle (29.1 deg.) of the liquid crystal used was taken as 1.0) in FIG. 13.

As apparent from FIG. 13, it is possible to attain an objective transmittance for the liquid crystal (i.e., a maximum transmittance based on the tilt angle Ⓗ of 29.1 deg.) by setting the Vs2 to satisfy the relationship: Vs2≧9.8 (volts).

In this example, when the relationship: Vs2≧9.8 (volts) is fulfilled, the above-mentioned formula (12) (Vs2≧{ΔQ×M/(Clc+Cs)}+Vs1) is also satisfied.

According to this example (Example 5), in the case of using a liquid crystal material exhibiting a larger temperature-dependence of Ps, the drive voltage Vs2 is set to satisfy the above formula (12) for varying Ps at respective operation temperatures, thus ensuring a good luminance and a high contrast.

As described above, according to the liquid crystal apparatus of the present invention used in Examples 4 and 5, desired display states can be ensured by selecting and setting driving conditions, physical properties of the liquid crystal used and a panel structure so as to fulfill the above-mentioned formula (12) when the liquid crystal apparatus is driven in an active matrix drive scheme.

EXAMPLE 6

A liquid crystal panel having a structure as shown in FIGS. 1 and 2 was prepared.

The thus-prepared liquid crystal panel had 1024×3 (R (red), G (green) and B (blue))×768 pixels each having a size of 300 μm×100 μm (corr. to 1 bit) at a pitch of 300 μm and each having an opening rate of 70%.

In this example, a layer storage capacitance 32 was provided in order to effect good gradational display. Specifically, between a pixel electrode 15 and a storage capacitance 30, a 3000 Å-thick film of $SbTiO_3$ as a dielectric layer material was formed by sputtering instead of an extended portion of a gate insulation film (SiNx film) as in Example 1. The dielectric layer material ($SbTiO_3$) had a relative dielectric constant (∈r) of 150. An areal ratio of the storage capacitance electrode 30 and the pixel electrode 15 was set to 1:5.

A blank cell was prepared in the following manner.

On a substrate 21 provided with an a-TFT 14 and the pixel electrode 15, a 1 wt. %-solution of polyamic acid ("LP-64", mfd. by Toray K.K.) (as a polyimide precursor) in a mixture solvent of NMP (N-methylpyrrolidone)/n-BC (n-butyl cellosolve) (=2/1) was applied by spin coating for 20 sec. at 2700 rpm and dried for 5 min. at 80° C. in an oven, followed by hot curing for 1 hour at 200° C. in the oven to form a 10 nm-thick polyimide film. The polyimide film was subjected to rubbing to provide a polyimide alignment film 43*a*.

On the surface of the thus-treated substrate (active matrix plate 20), a 0.008 wt. %-dispersion of silica beans (spacer beads) having an average diameter of 2.2 μm in isopropyl alcohol (IPA) was spin-coated for 10 sec. at 1500 rpm so as to provide a dispersion density of ca. 300 (particles)/mm$^2$.

On another substrate 41 provided with a common electrode 42, a 10 nm-thick polyimide film (similar to that for the active matrix plate 20) was formed and subjected to rubbing to provide a polyimide alignment film 43*b*, thus preparing a counter plate 40.

The thus prepared active matrix plate 20 and counter plate 40 were applied to each other via the silica beads so that their rubbing axes were substantially parallel with each other and in the same direction, followed by hot curing for 90 min. at 150° C. in an oven, thus preparing a blank cell with a cell gap (corr. to a liquid crystal layer thickness) of ca. 2.0 μm.

Into the gap of the blank cell, a liquid crystal 49 (an antiferroelectric liquid crystal layer having a Ps (spontaneous polarization) of 200 nC/cm$^2$ at 30° C. as measured by the triangular wave method and an ∈r (relative dielectric constant) of 5) was injected, thus preparing a liquid crystal panel (device).

The liquid crystal 49 showed a V-T characteristic as shown in FIG. 3 wherein a transmittance changed continuously with a change in a voltage applied to the liquid crystal 49 and provided a maximum at a saturation voltage V0 of 5 (V) and there was no clear threshold voltage. Accordingly, it is possible change a transmittance continuously by controlling the voltage applied to the liquid crystal 49.

The physical and electrical properties for the above-prepared liquid crystal panel with respect to the formula (14) described hereinabove were summarized a follows:

Ps=200 nC/cm$^2$,

S=300 μm×100 μm×0.7 (opening rate: 70%),

V0=5 volts,

Clc=0.664 pF (obtained from the pixel electrode area (S), the liquid crystal layer thickness (2.0 μm) and ∈r (=5) of the liquid crystal 49), Cs=26.55 pF (obtained from the storage capacitance electrode area (S/5), the thickness (0.3 μm) of the dielectric material layer and ∈r (=150) of the dielectric material layer),

A=0.07.

More specifically, the value A (={(Clc+Cs)max—(Clc+Cs)min}/(Clc+Cs)ave) was determined in the following manner.

Clc (liquid crystal capacitance) may be determined by the pixel electrode area, the liquid crystal layer thickness and the relative dielectric constant (∈r) of the liquid crystal. Among these factors, fluctuations in the pixel electrode area and ∈r are generally very small, thus being negligible factors. Accordingly, a fluctuation in Clc within the liquid crystal panel is principally attributable to a distribution of the liquid crystal layer thickness.

When the thickness of the liquid crystal layer was measured by utilizing birefringence of the liquid crystal at 25

(meaning) points (A1 to E5: equally spaced 5×5 points in the liquid crystal panel), a maximum-thickness of 2.10 μm, a minimum thickness of 1.90 μm and an average thickness of 2.00 μm were obtained. Based on these thicknesses, a maximum Clc (Clc-max) of 0.699 pF, a minimum Clc (Clc-min) of 0.632 pF and an average Clc (Clc-ave) of 0.664 pF were determined.

Similarly, a fluctuation in Cs (storage capacitance) within the liquid crystal panel is principally attributable to a distribution of the layer thickness of the dielectric material.

When the thickness of the dielectric material layer was measured in a similar manner (as in the liquid crystal layer), three values including a maximum thickness of 0.32 μm, a minimum thickness of 0.28 μm and an average thickness of 0.30 μm were obtained. Based on these values, a maximum Cs (Cs-max) of 27.45 pF, a minimum Cs (Cs-min) of 25.65 pF and an average Cs (Cs-ave) of 26.55 pF were determined.

Based on the above values of Clc and Cs (at 25 points), values of the sum of Clc and Cs (Clc+Cs) were summarized in Table 2.

TABLE 2

| Measuring point | Clc + C2 (pF) 1 | 2 | 3 | 4 | 5 |
|---|---|---|---|---|---|
| A | 28.167 | 28.1 | 27.861 | 28.872 | 28.002 |
| B | 27.123 | 27.631 | 26.997 | 27.102 | 27.482 |
| C | 26.887 | 26.582 | 27.262 | 28.869 | 26.458 |
| D | 27.669 | 27.145 | 27.024 | 27.225 | 27.368 |
| E | 27.984 | 27.59 | 27.1 | 27.69 | 28.135 |

Based on the values (Clc+Cs) shown in Table 2, A={(Clc+Cs)max—(Clc+Cs)min}/(Clc+Cs)ave=0.07 was obtained.

When the above-mentioned parameter values for the formula (14), i.e., $$1/(n-1)>A(2Ps\times S)/V0(Clc+Cs)\text{ave}$$

were applied to the formula (14), the right side provided a value of 0.0432, which satisfied the formula (14) where n=16 (1/15>0.0432), thus allowing a gradational display with 16 gradational levels.

The above-prepared liquid crystal panel wa driven in an active matrix drive scheme with interlaced scanning under the following conditions:

Frequency=60 Hz,

Vs (providing T (transmittance)=100%): ±5 (V),

Vs (providing T=0%): 0 (V),

Vg (gate voltage): +15 (V), and

Ton (gate selection period): 20 μsec (which was sufficiently shorter than a response time (200 μsec) of the liquid crystal required for switching between point A (T=100%) and point B (T=100%) as shown in FIG. 3).

As a result, good optical states (16 gradational levels for each pixel) corresponding to data signal voltages for 16 bit were displayed.

In this example (Example 6), although the liquid crystal material having a Ps of 200 nC/cm$^2$ was used, the similar results can be attained by using a liquid crystal material having a Ps of at most 200 nC/cm$^2$ since the condition (14) is satisfied.

EXAMPLE 7

A liquid crystal panel was prepared and driven in the same manner as in Example 6 except that the liquid crystal material was changed to an antiferroelectric liquid crystal (Ps=50 nC/cm$^2$, ∈r=5, V0=5 volts) and the dielectric material layer was changed to a tantalum oxide (TaOx) film (thickness=2000 Å, ∈r=25).

The physical and electrical properties for the above-prepared liquid crystal panel with respect to the formula (14) described hereinabove were summarized a follows:

Ps=50 nC/cm$^2$,

S=300 μm×100 μm×0.7 (opening rate: 70%),

V0=5 volts,

Clc=0.664 pF (obtained from the pixel electrode area (S), the liquid crystal layer thickness (2.0 μm) and ∈r (=5) of the liquid crystal 49), Cs=6.64 pF (obtained from the storage capacitance electrode area (S/5), the thickness (0.2 μm) of the dielectric material layer and ∈r (=25) of the dielectric material layer), A=0.07 (determined similarly as in Example 6).

When the above-mentioned parameter values for the formula (14), i.e., $$1/(n-1)>A(2Ps\times S)/V0(Clc+Cs)\text{ave}$$

were applied to the formula (14), the right side provided a value of 0.0403, which satisfied the formula (14) where n=16 (1/15>0.0403), thus allowing a gradational display with 16 gradational levels.

As a result of the driving of the liquid crystal panel, good optical states (16 gradational levels for each pixel) corresponding to data signal voltages for 16 bit were displayed.

In this example (Example 7), although the liquid crystal material having a Ps of 50 nC/cm$^2$ was used, the similar results can be attained by using a liquid crystal material having a Ps of at most 50 nC/cm$^2$ since the condition (14) is satisfied.

EXAMPLE 8

A liquid crystal panel was prepared and driven in the same manner as in Example 6 except that the liquid crystal material was changed to an antiferroelectric liquid crystal (Ps 20 nC/cm$^2$, ∈r=5, V0=5 volts), the dielectric material layer was changed to a silicon nitride (SiNx) film (thickness=3000 Å, ∈r=7) and the areal ratio (1:5) of the storage capacitance electrode and the pixel electrode was changed to 2:5.

The physical and electrical properties for the above-prepared liquid crystal panel with respect to the formula (14) described hereinabove were summarized a follows:

Ps=20 nC/cm$^2$,

S=300 μm×100 μm×0.7 (opening rate: 70%),

V0=5 volts,

Clc=0.664 pF (obtained from the pixel electrode area (S), the liquid crystal layer thickness (2.0 μm) and ∈r (=5) of the liquid crystal 49), Cs=2.48 pF (obtained from the storage capacitance electrode area (2S/5), the thickness (0.3 μm) of the dielectric material layer and ∈r (=7) of the dielectric material layer), A=0.07 (determined similarly as in Example 6).

When the above-mentioned parameter values for the formula (14), i.e., $$1/(n-1)>A(2Ps\times S)/V0(Clc+Cs)\text{ave}$$

were applied to the formula (14), the right side provided a value of 0.0374, which satisfied the formula (14) where n=16 ($1/15>0.0374$), thus allowing a gradational display with 16 gradational levels.

As a result, good optical states (16 gradational levels for each pixel) corresponding to data signal voltages for 16 bit were displayed.

In this example (Example 8), although the liquid crystal material having a Ps of 20 nC/cm$^2$ was used, the similar results can be attained by using a liquid crystal material having a Ps of at most 20 nC/cm$^2$ since the condition (14) is satisfied.

In Examples 6–8, the gradational display for 16 bit was performed. However, as apparent from the formula (14), it is possible to effect a desired gradational display by appropriately selecting and setting the liquid crystal material used and the panel structure so as to satisfy the formula (14) when the liquid crystal panel using the liquid crystal material having a spontaneous polarization was subjected to a high-speed active matrix drive using TFTs.

What is claimed is:

1. A liquid crystal apparatus, comprising:

a liquid crystal device including an active matrix substrate, a counter substrate disposed opposite thereto, and a liquid crystal disposed between the active matrix substrate and the counter substrate; said active matrix substrate having thereon a plurality of scanning signal lines, a plurality of data signal lines intersecting the scanning signal lines, a plurality of switching devices each disposed at an intersection of the scanning signal lines and the data signal lines and connected to an associated one of the scanning signal lines, and a plurality of pixel electrodes each connected via one of the switching devices to an associated one of the data signal lines and form a pixel together with the liquid crystal thereat for applying a data signal voltage to the liquid crystal at the pixel; said liquid crystal having a spontaneous polarization and causing a state change accompanied with comsumption of electric charge completed by taking a response time, and drive means for sequentially selecting the scanning signal lines each in a scanning selection period and applying data signal voltages to the pixels along an associated scanning signal line, wherein the scanning selection period for a scanning signal line is shorter than the response time for the liquid crystal at a pixel on the scanning signal line thus being liable to fail in completing consumption of electric charge so as to result in a desired state change, and the data signal voltage applied to the pixel is set to include a compensation voltage for compensating for a voltage decrease caused by electric charge consumed in a scanning non-selection period subsequent to the scanning selection period.

2. An apparatus according to claim 1, wherein when the drive means applies a data signal voltage having a polarity which is inverted for each frame, the compensation voltage provides a maximum $\Delta V_{max1}$ (volt) determined according to the following equation:

$$\Delta V_{max1}=2Ps\times S/C_{lc}(1+\alpha),$$

wherein Ps represents a spontaneous polarization (C/cm$^2$) of the liquid crystal, S represents an area (cm$^2$) of each pixel electrode, $C_{lc}$ represents a liquid crystal capacitance (F) for each pixel, and $\alpha=Cs/C_{lc}$ where Cs represents a storage capacitance (F) for each pixel disposed in parallel with the liquid crystal capacitance.

3. An apparatus according to claim 2, wherein the compensation voltage is a correction voltage $\Delta V_1$ (volt) converted from the maximum $\Delta V_{max1}$ (volt) proportional thereto.

4. An apparatus according to claim 1, wherein when the drive means applies a data signal voltage having a polarity which is identical for each frame, the compensation voltage provides a maximum $\Delta V_{max1}$ (volt) determined according to the following equation:

$$\Delta V_{max1}=Ps\times S/C_{lc}(1+\alpha),$$

wherein Ps represents a spontaneous polarization (C/cm$^2$) of the liquid crystal, S represents an area (cm$^2$) of each pixel electrode, $C_{lc}$ represents a liquid crystal capacitance (F) for each pixel, and $\alpha=Cs/C_{lc}$ where Cs represents a storage capacitance (F) for each pixel disposed in parallel with the liquid crystal capacitance.

5. An apparatus according to claim 4, wherein the compensation voltage is a correction voltage $\Delta V_1$ (volt) converted from the maximum $\Delta V_{max1}$ (volt) proportional thereto.

6. An apparatus according to claim 2, wherein the switching device is a thin film transistor.

7. An apparatus according to claim 6, wherein the storage capacitance is constituted by disposing a film identical to a gate insulation film of the thin film transistor between the pixel electrode and a storage capacitance electrode.

8. An apparatus according to claim 1, wherein the liquid crystal has alignment characteristic and voltage-transmittance characteristic such that the liquid crystal assumes a first alignment state exhibiting a first transmittance under no voltage application, is tilted from the first alignment state to a second alignment state in one direction when supplied with a voltage of a first polarity to exhibit a second transmittance at a prescribed voltage $V_0$, and is tilted from the first alignment state to a third alignment state in the other direction when supplied with a voltage of a second polarity opposite to the first polarity to exhibit a second transmittance at a prescribed voltage $-V_0$, and the liquid crystal changes its transmittance continuously between the first transmittance and the second transmittance depending on a voltage applied thereto to effect gradational display.

9. An apparatus according to claim 1, wherein the liquid crystal is a chiral smectic liquid crystal.

10. An apparatus according to claim 1, wherein the liquid crystal is a ferroelectric liquid crystal.

11. An apparatus according to claim 1, wherein the liquid crystal is an antiferroelectric liquid crystal.

12. A liquid crystal apparatus, comprising:

a liquid crystal device including an active matrix substrate, a counter substrate disposed opposite thereto, and a liquid crystal disposed between the active matrix substrate and the counter substrate; said active matrix substrate having thereon a plurality of scanning signal lines, a plurality of data signal lines intersecting the scanning signal lines, a plurality of switching devices each disposed at an intersection of the scanning signal lines and the data signal lines and connected to an associated one of the scanning signal lines, and a plurality of pixel electrodes each connected via one of the switching devices to an associated one of the data signal lines and form a pixel together with the liquid crystal thereat for applying a data signal voltage to the liquid crystal at the pixel; each pixel being provided with a storage capacitance disposed in parallel with the liquid crystal, and said liquid crystal having a spontaneous polarization and causing a state change accompanied with compumption of electric charge completed by taking a response time, and drive means for sequentially selecting the scanning signal lines each in a scanning selection period and applying data signal voltages to the pixels along an associated scanning signal line, wherein the scanning selection period for a scanning signal line is shorter than the response time for the liquid crystal at a pixel on the scanning signal line thus being liable fail in completing consumption of electric charge so as to result in a desired state change, and the liquid crystal device and the drive means are set to satisfy the following conditions:

$$Vs2 \geqq \{\Delta Q \times M/(C_{lc}+Cs)\}+Vs1 \quad (12)$$

wherein Vs2 is a data signal voltage (volt) applied to one pixel, Vs1 is a voltage (volt) for providing writing data for the pixel based on a voltage-transmittance characteristic of the liquid crystal, ΔQ is an amount (C) of inversion of the spontaneous polarization of the liquid crystal, $C_{lc}$ is a liquid crystal capacitance (F) at one pixel, Cs is a storage capacitance (F) at one pixel, and M is a proportion of electric charge not consumed in a scanning selection period for one scanning signal line.

13. An apparatus according to claim 12, wherein the switching device is a thin film transistor.

14. An apparatus according to claim 13, wherein the storage capacitance is constituted by disposing a film identical to a gate insulation film of the thin film transistor between the pixel electrode and a storage capacitance electrode.

15. An apparatus according to claim 12, wherein the liquid crystal has alignment characteristic and voltage-transmittance characteristic such that the liquid crystal assumes a first alignment state exhibiting a first transmittance under no voltage application, is tilted from the first alignment state to a second alignment state in one direction when supplied with a voltage of a first polarity to exhibit a second transmittance at a prescribed voltage $V_0$, and is tilted from the first alignment state to a third alignment state in the other direction when supplied with a voltage of a second polarity opposite to the first polarity to exhibit a second transmittance at a prescribed voltage $-V_0$, and the liquid crystal changes its transmittance continuously between the first transmittance and the second transmittance depending on a voltage applied thereto to effect gradational display.

16. An apparatus according to claim 12, wherein the liquid crystal is a chiral smectic liquid crystal.

17. An apparatus according to claim 12, wherein the liquid crystal is a ferroelectric liquid crystal.

18. An apparatus according to claim 12, wherein the liquid crystal is an antiferroelectric liquid crystal.

19. A liquid crystal apparatus, comprising:

a liquid crystal device including an active matrix substrate, a counter substrate disposed opposite thereto, and a liquid crystal disposed between the active matrix substrate and the counter substrate; said active matrix substrate having thereon a plurality of scanning signal lines, a plurality of data signal lines intersecting the scanning signal lines, a plurality of switching devices each disposed at an intersection of the scanning signal lines and the data signal lines and connected to an associated one of the scanning signal lines, and a plurality of pixel electrodes each connected via one of the switching devices to an associated one of the data signal lines and form a pixel together with the liquid crystal thereat for applying a data signal voltage to the liquid crystal at the pixel; each pixel being provided with a storage capacitance disposed in parallel with the liquid crystal, and said liquid crystal having a spontaneous polarization and causing a state change accompanied with consumption of electric charge completed by taking within a response time, and drive means for sequentially selecting the scanning signal lines each in a scanning selection period and applying data signal voltages to the pixels along an associated scanning signal line, wherein the scanning selection period for a scanning signal line is shorter than the response time for the liquid crystal at a pixel on the scanning signal line thus being liable to fail in completing consumption of electric charge so as to result in a desired state change, and the liquid crystal device and the drive means are set to satisfy the following conditions:

$$1/(n-1) > A(2Ps \times S)/V_0(C_{lc}+Cs)_{ave},$$

wherein n represents the number of gradational levels per one period; A is represented by the following equation:

$$A=\{(C_{lc}+Cs)_{max}-(C_{lc}+Cs)_{min}\}/(C_{lc}+Cs)_{ave},$$

where $(C_{lc}+Cs)_{max}$ represents a maximum of the sum ($C_{lc}$+Cs) of a liquid crystal capacitance $C_{lc}$ (F) at one pixel and a storage capacitance Cs (F) at one pixel, ($C_{lc}$+Cs)min represents a minimum of ($C_{lc}$+Cs) and $(C_{lc}+Cs)_{ave}$ represents an average of ($C_{lc}$+Cs); Ps represents a spontaneous polarization ($C/cm^2$) per unit area of the liquid crystal; S represents a pixel electrode area ($cm^2$) at one pixel; and $V_0$ represents a saturation voltage (volt) for the liquid crystal providing a maximum transmittance.

20. An apparatus according to claim 19, wherein the switching device is a thin film transistor.

21. An apparatus according to claim 20, wherein the storage capacitance is constituted by disposing a film identical to a gate insulation film of the thin film transistor between the pixel electrode and a storage capacitance electrode.

22. An apparatus according to claim 19, wherein the liquid crystal has alignment characteristic and voltage-transmittance characteristic such that the liquid crystal assumes a first alignment state exhibiting a first transmittance under no voltage application, is tilted from the first alignment state to a second alignment state in one direction when supplied with a voltage of a first polarity to exhibit a second transmittance at a prescribed voltage $V_0$, and is tilted from the first alignment state to a third alignment state in the other direction when supplied with a voltage of a second polarity opposite to the first polarity to exhibit a second transmittance at a prescribed voltage $-V_0$, and the liquid crystal changes its transmittance continuously between the first transmittance and the second transmittance depending on a voltage applied thereto to effect gradational display.

23. An apparatus according to claim 19, wherein the liquid crystal is a chiral smectic liquid crystal.

24. An apparatus according to claim 19, wherein the liquid crystal is a ferroelectric liquid crystal.

25. An apparatus according to claim 19, wherein the liquid crystal is an antiferroelectric liquid crystal.

* * * * *

UNITED STATES PATENT AND TRADEMARK OFFICE

CERTIFICATE OF CORRECTION

PATENT NO. : 6,496,170 B1 
DATED : December 17, 2002
INVENTOR(S) : Akio Yoshida et al.

It is certified that error appears in the above-identified patent and that said Letters Patent is hereby corrected as shown below:

Column 1,
Line 17, “line” should read -- lines --.

Column 4,
Lines 13 and 57, “and” should read -- to --; and

Column 7,
Line 28, “film 43*a*” should read -- film 43*a* is provided --.

Column 8,
Line 21, “liens” should read -- lines --.

Column 9,
Line 2, “electrical” should read -- electricallly --;
Line 4, “becomes” should read -- reaches --; and
Line 16, “control” should read -- controlling --.

Column 10,
Line 18, “ten psec to several hundred psec” should read -- tens of $\mu$sec to several hundred $\mu$sec --.

Column 11,
Line 11, “(while)” should read -- (white) --.

Column 12,
Lines 20 and 21, “($T_C$ / $T_E$)” should read -- ($T_C$ - $T_E$) --; and
Line 60, “compensate” should read -- compensate for --.

Column 13,
Line 26, “show” should read -- shown --.

Column 14,
Line 50, “IN” should read -- In --.

Column 15,
Line 1, “is is” should read -- is --;
Line 11, “ai” should read -- a --; and
Line 28, “(while)” should read -- (white) --.

Column 16,
Lines 8 and 9, “{$T_C$ - $T_E$)” should read -- {($T_C$ - $T_E$) --; and
Line 48, “compensate” should read -- compensate for --.

UNITED STATES PATENT AND TRADEMARK OFFICE

CERTIFICATE OF CORRECTION

PATENT NO. : 6,496,170 B1
DATED : December 17, 2002
INVENTOR(S) : Akio Yoshida et al.

It is certified that error appears in the above-identified patent and that said Letters Patent is hereby corrected as shown below:

Column 17,
Line 34, “which” should read -- which a --.

Column 18,
Line 15, “from” should be deleted; and
Lines 26 and 59, “show” should read -- shown --.

Column 19,
Line 22, “(while)” should read -- (white) --.

Column 20,
Line 22, “may” should read -- may be --.

Column 22,
Line 19, “for active” should read -- for an active --; and
Line 37, “as” should read -- was --.

Column 23,
Lines 6 and 32, “show” should read -- shown --.

Column 24,
Line 57, “was” should read -- were --.

Column 25,
Line 34, “for active” should read -- for an active --.

Column 26,
Line 57, “M” should read -- M is --.

Column 27,
Line 17, “the” should read -- for the --.

Column 28,
Line 11, “beans” should read -- beads --;
Line 38, “change” should read -- to change --; and
Line 42, “a” should read -- as --.

Column 29,
Line 44, “wa” should read -- was --.

Column 31,
Line 31, “and” should read -- to --.
Line 35, “comsumption” should read -- consumption --.

UNITED STATES PATENT AND TRADEMARK OFFICE

CERTIFICATE OF CORRECTION

PATENT NO. : 6,496,170 B1 
DATED : December 17, 2002
INVENTOR(S) : Akio Yoshida et al.

It is certified that error appears in the above-identified patent and that said Letters Patent is hereby corrected as shown below:

Column 32,
Lines 24 and 25, "characteristic" should read -- characteristics --; and
Line 58, "and" should read -- to --.
Line 63, "compumption" should read -- consumption --.

Column 33,
Line 5, "liable fail" should read -- liable to fail --;
Lines 29 and 30, "characteristic" should read -- characteristics --; and
Line 63, "and" should read -- to --.

Column 34,
Lines 42 and 43, "characteristic" should read -- characteristics --.

Signed and Sealed this

Fifteenth Day of July, 2003

JAMES E. ROGAN
*Director of the United States Patent and Trademark Office*